US010370805B2

(12) United States Patent
Thrall et al.

(10) Patent No.: US 10,370,805 B2
(45) Date of Patent: Aug. 6, 2019

(54) ADJUSTABLE BOLTED STEEL PLATE CONNECTION

(71) Applicants: University of Notre Dame du Lac, South Bend, IN (US); HNTB Corporation, New York, NY (US)

(72) Inventors: Ashley P. Thrall, Notre Dame, IN (US); Evan J. Gerbo, Notre Dame, IN (US); Theodore P. Zoli, III, New York, NY (US)

(73) Assignees: University of Notre Dame du Lac, Notre Dame, IN (US); HNTB Corporation, New York, NY (US)

( * ) Notice: Subject to any disclaimer, the term of this patent is extended or adjusted under 35 U.S.C. 154(b) by 167 days.

(21) Appl. No.: 15/610,451

(22) Filed: May 31, 2017

(65) Prior Publication Data

US 2017/0268186 A1 Sep. 21, 2017

Related U.S. Application Data

(63) Continuation of application No. 15/292,801, filed on Oct. 13, 2016, now Pat. No. 10,190,271.

(60) Provisional application No. 62/343,526, filed on May 31, 2016, provisional application No. 62/286,678, filed on Jan. 25, 2016, provisional application No.

(Continued)

(51) Int. Cl.

| | |
|---|---|
| ***E04C 3/40*** | (2006.01) |
| ***E01D 6/00*** | (2006.01) |
| ***E01D 4/00*** | (2006.01) |
| ***E04C 3/08*** | (2006.01) |
| ***E01D 15/133*** | (2006.01) |
| *E04C 3/04* | (2006.01) |

(52) U.S. Cl.

CPC ..... *E01D 6/00* (2013.01); *E01D 4/00* (2013.01); *E01D 15/133* (2013.01); *E04C 3/08* (2013.01); *E04C 3/40* (2013.01); *E04C 2003/0491* (2013.01)

(58) Field of Classification Search

CPC . E01D 19/00; E01D 2101/00; E01D 2101/30; E04C 2/00; E04C 2/08; E04C 3/04; E04C 3/08; E04C 3/40

USPC ..... 14/4, 5, 13, 14, 78

See application file for complete search history.

(56) References Cited

U.S. PATENT DOCUMENTS 2,334 A 11/1841 Cottrell
84,288 A * 11/1868 Linville ..... E01D 6/00 14/4

(Continued)

FOREIGN PATENT DOCUMENTS

| | | |
|---|---|---|
| CN | 201891069 U | 7/2011 |
| CN | 202248251 U | 5/2012 |
| CN | 103103929 A | 5/2013 |

*Primary Examiner* — Gary S Hartmann

(74) *Attorney, Agent, or Firm* — Greenberg Traurig, LLP

(57) ABSTRACT

An adjustable structural connection can be used to join steel structural elements at a range of angles and is capable of adjusting in situ to accommodate additional angles or tolerances through cold bending. Pre-bent plate or plates may be loosely fitted around steel structural elements, such that holes in the plates align with holes of the steel structural elements. Placing bolts through the aligned holes and tightening those bolts can be used to cold bend the plate or plates and conform the angle of the pre-bent plates to a different angle defined by an apex joint of two steel structural elements. Specific tightening procedures may be employed.

12 Claims, 24 Drawing Sheets

Related U.S. Application Data

62/240,776, filed on Oct. 13, 2015, provisional application No. 62/393,758, filed on Sep. 13, 2016, provisional application No. 62/414,957, filed on Oct. 31, 2016.

(56) References Cited

U.S. PATENT DOCUMENTS

| | | | | | |
|---|---|---|---|---|---|
| 118,566 | A | | 8/1871 | Weimer | |
| 363,970 | A | * | 5/1887 | Sherwood | E01D 15/133<br>14/14 |
| 447,422 | A | | 3/1891 | Zenke | |
| 779,370 | A | | 1/1905 | Miller | |
| 1,163,641 | A | | 12/1915 | Cummings | |
| 1,962,820 | A | | 6/1934 | Knight | |
| 2,382,478 | A | * | 8/1945 | Guthrie | E01D 15/133<br>14/14 |
| 2,559,741 | A | | 7/1951 | Wachsmann | |
| 3,152,347 | A | | 10/1964 | Williams | |
| 4,089,148 | A | | 5/1978 | Oehmsen | |
| 4,156,433 | A | | 5/1979 | Beaulieu | |
| 4,179,860 | A | | 12/1979 | Reale | |
| 4,551,957 | A | | 11/1985 | Madray | |
| 4,628,560 | A | | 12/1986 | Clevett et al. | |
| 4,706,436 | A | | 11/1987 | Mabey | |
| 4,957,186 | A | | 9/1990 | Reetz | |
| 5,024,031 | A | | 6/1991 | Hoberman | |
| 5,090,166 | A | * | 2/1992 | Johnson | E04B 1/24<br>403/217 |
| 5,524,397 | A | * | 6/1996 | Byers | E04B 1/2608<br>403/232.1 |
| 5,724,691 | A | | 3/1998 | Wiedeck | |
| 6,553,698 | B1 | | 4/2003 | Kemeny | |
| 8,800,239 | B2 | | 8/2014 | Yang | |
| 10,011,961 | B2 | | 7/2018 | Bouleau | |

* cited by examiner

130

140

300

Assumed parameters:

$t_m$=25.4 mm (1.0 in.), $d_m$=254 mm (10 in.), $\beta=\gamma=10°$, $l_1=l_2$=483mm (19 in.), $d_{mh}$=47.6 mm (1.875 in.), $r_b=r_t$=102 mm (4.0 in.), $d_{ph}$=23.8 mm (0.9375 in.)

Assumed parameters:

$\beta=\gamma=10°$, $l_1=l_2=483$mm (19 in.), $d_{mh}=47.6$ mm (1.875 in.), $r_b=r_f=102$ mm (4.0 in.), $d_{ph}=23.8$ mm (0.9375 in.)

310

400

410

500

510

520

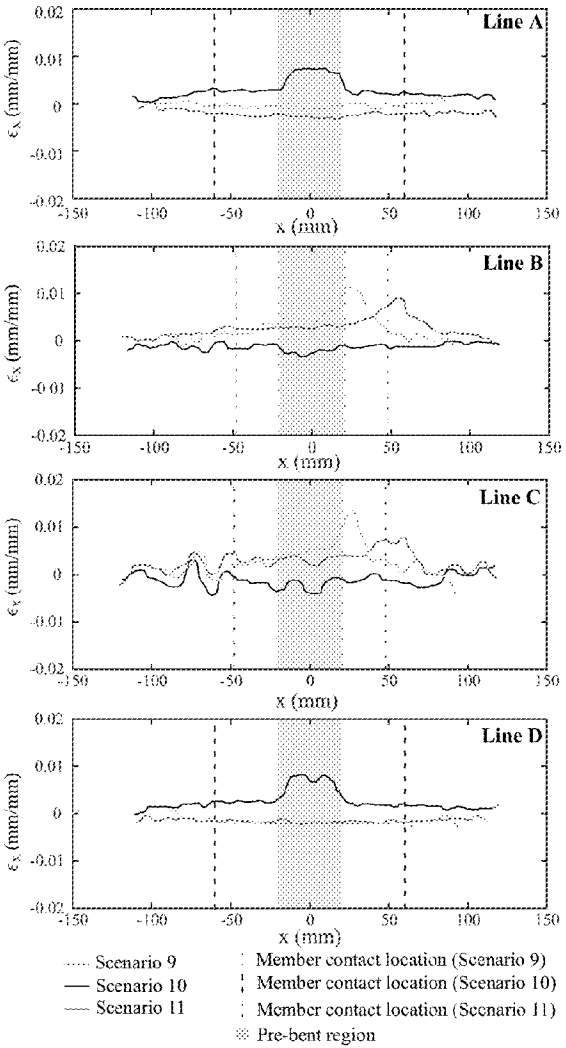
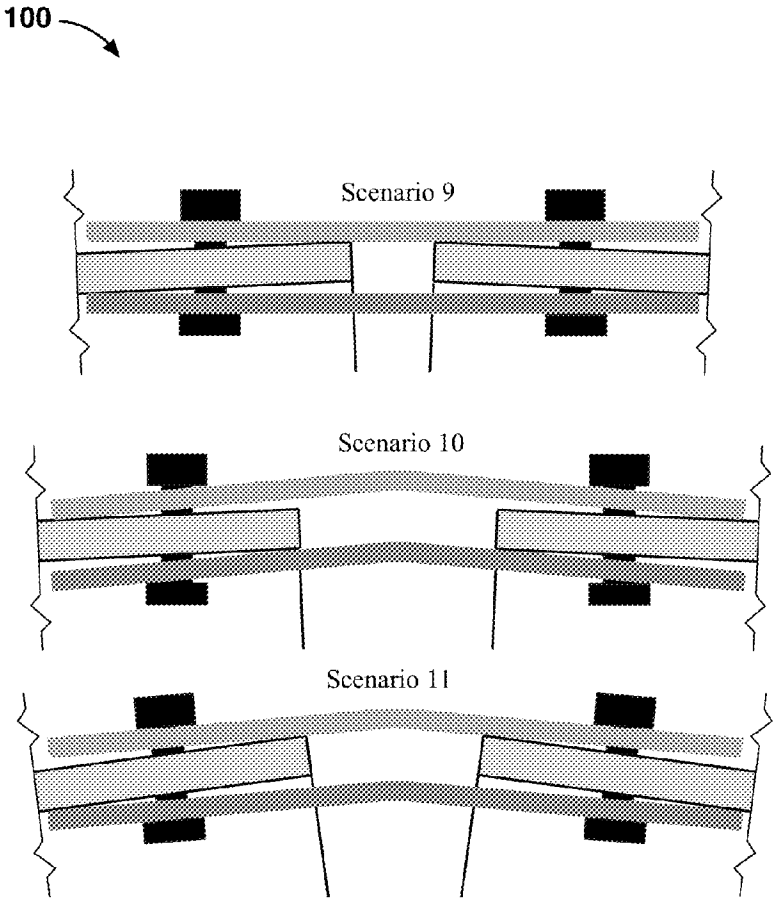
FIG. 11

1300

| Symbol | Definition | Values Investigated |
|---|---|---|
| **Plate Geometry** | | |
| $\gamma$ | Top plate angle | 0°, 5°, 10°, and 15° |
| $\beta$ | Bottom plate angle | $\beta=\gamma$ |
| $l_1$ | Top plate length | 305 mm - 559 mm (25.4 mm increments)<br>[12 in. - 22 in. (1 in. increments)] |
| $l_2$ | Bottom plate length | $l_2=l_1$ |
| $r_t$ | Top plate radius | 63.5 mm, 102 mm<br>[2.5 in., 4 in.] |
| $r_b$ | Bottom plate radius | $r_b=r_t$ |
| $t_p$ | Plate thickness | 12.7 mm (0.5 in.) |
| $d_{ph}$ | Plate hole length | Oversized holes: 23.8 mm (0.9375 in.) |
| $l_3$ | Plate hole end distance | 76.2 mm (3 in.) |
| **Member Geometry** | | |
| $t_m$ | Member thickness | 12.7 mm - 38.1 mm (3.18 mm increments)<br>[0.5 in. - 1.5 in. (0.125 in. increments)] |
| $d_m$ | Member depth | 20 mm, 254 mm, and 305 mm<br>(8 in., 10 in., and 12 in.) |
| $d_{mh}$ | Member hole length | Oversized holes: 23.8 mm (0.9375 in.)<br>Short slots: 25.4 mm (1 in.)<br>Long slots: 47.6 mm (1.875 in.) |
| $l_4$ | Member hole end distance | 76.2 mm (3 in.) |
| **Connection Configuration** | | |
| $\alpha$ | Member angle | $\alpha = \gamma \pm 5°$ (0.5° increments) |
| g | Gap between members | $(g \geq d_m \sin\alpha + e)$ - max (0.794 mm increments, e=3.18 mm)<br>(0.03125 in. increments, e=0.125 in.) |
| $d_b$ | Bolt diameter | 19.1 mm (0.75 in.) |

FIG. 13

1400

| | $\gamma = \beta$ (deg.) | $\alpha$ (deg.) | $\delta$ (deg.) | $l_1 = l_2$ (mm) | Tightening Procedure increment (pattern*) |
|---|---|---|---|---|---|
| 1 | 10 | 17.5 | 7.5 | 483 | 1 turn/bolt (x) |
| 2 | 10 | 17.5 | 7.5 | 483 | 3 turns/bolt (x) |
| 3 | 10 | 17.5 | 7.5 | 483 | Fully tighten bolt (x) |
| 4 | 10 | 17.5 | 7.5 | 483 | 1 turn/bolt (cw) |
| 5 | 10 | 17.5 | 7.5 | 483 | 1 turn/bolt (ccw) |
| 6 | 10 | 12.5 | 2.5 | 483 | 1 turn/bolt (x) |
| 7 | 10 | 7.5 | -2.5 | 483 | 1 turn/bolt (x) |
| 8 | 10 | 2.5 | -7.5 | 483 | 1 turn/bolt (x) |
| 9 | 0 | 2.5 | 2.5 | 381 | 1 turn/bolt (x) |
| 10 | 5 | 2.5 | -2.5 | 432 | 1 turn/bolt (x) |
| 11 | 5 | 7.5 | 2.5 | 432 | 1 turn/bolt (x) |
| 12 | 15 | 12.5 | -2.5 | 533 | 1 turn/bolt (x) |
| 13 | 15 | 17.5 | 2.5 | 533 | 1 turn/bolt (x) |

FIG. 14

ADJUSTABLE BOLTED STEEL PLATE CONNECTION

CROSS REFERENCE TO RELATED APPLICATION

This application is a non-provisional application claiming priority from U.S. Provisional Application Ser. No. 62/343,526 filed May 31, 2016, entitled "Adjustable Plate Connection," U.S. Provisional Application Ser. No. 62/393,758 filed Sep. 13, 2016, entitled "Adjustable Plate Connection," and U.S. Provisional Application Ser. No. 62/414,957 filed Oct. 31, 2016, entitled "Adjustable Plate Connection," and is a continuation of U.S. Non-Provisional patent application Ser. No. 15/292,801 filed Oct. 13, 2016 entitled "Adjustable Modules for Variable Depth Structures" which in turns claims priority from U.S. Provisional Applications Ser. No. 62/240,776 filed Oct. 13, 2015, entitled "Adjustable Module and Structure" and Ser. No. 62/286,678, filed Jan. 25, 2016, entitled "Adjustable Module for Variable Depth Arch Bridges," the entireties of which are incorporated herein by reference.

GOVERNMENT LICENSE RIGHTS

This invention was made with government support under CMMI-1351272 awarded by the National Science Foundation. The government has certain rights in the invention.

FIELD OF THE DISCLOSURE

The present disclosure relates generally to a unique approach for joining steel members at a range of angles with the capability of adjusting in situ to accommodate additional angles or tolerances: an adjustable bolted steel plate connection. This approach can be implemented for any moment-resisting joint between angled structural members in buildings (e.g., apex connections of portal frames) and bridges (e.g., angled connections of arch and truss bridges) for temporary or permanent construction. This disclosure provides specific detail to an example related to joining wide-flange steel sections.

BACKGROUND OF RELATED ART

In architecture, structural engineering, and construction, building or bridge components are typically fabricated according to a specific set of design specifications. Such components are often expensive because they are customized to fit the exact specifications of a particular building or bridge project.

During fabrication and construction, errors in the building or bridge specifications, manufacturing tolerances in the building or bridge components, or other unforeseen circumstances may cause a change in a structure's geometry, typically requiring new parts to be ordered. This may cause significant delays and add substantial costs to a building or bridge project.

BRIEF DESCRIPTION OF THE DRAWINGS

FIG. 11 is a set of graphs showing effects of varying plate and member angles on the circumferential strains.

FIG. 13 is a table of example geometric parameters for the adjustable plate connection.

FIG. 14 is a table summarizing different adjustable plate connection configuration parameters and their associated tightening procedures.

DETAILED DESCRIPTION

Figure 1A:
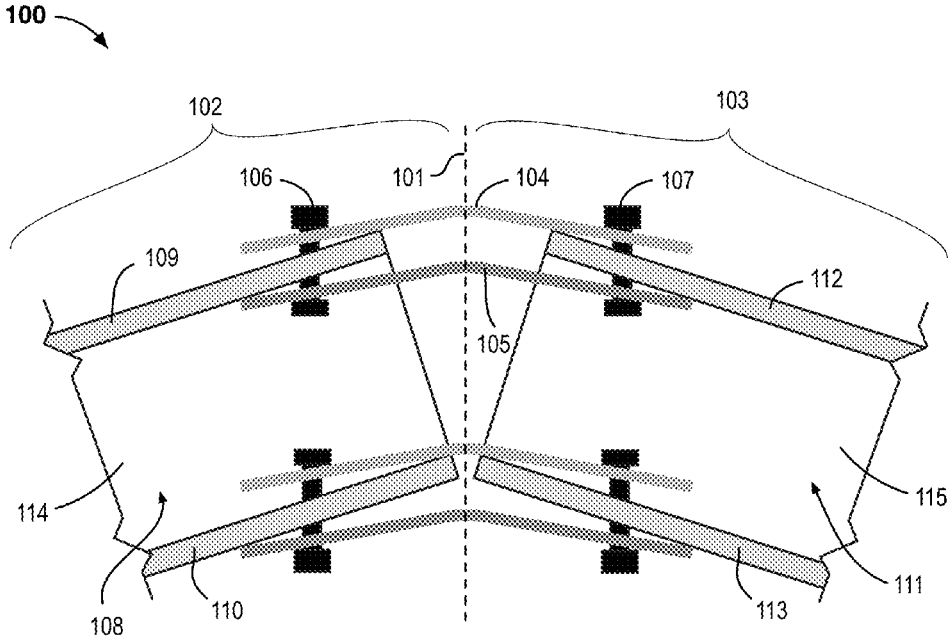
FIG. 1A is a conceptual illustration showing an elevation view of the field bending process showing an initial un-tightened connection.

The following description of example methods and apparatus is not intended to limit the scope of the description to the precise form or forms detailed herein. Instead the following description is intended to be illustrative so that others may follow its teachings.

The present invention presents a unique approach for rapid erection of steel structures using prefabricated, bolted connections that form moment-resisting joints between structural members at a range of angles. To make prefabricated components usable in a wide variety of structures, the subject invention is made to be adjustable such that the components vary in their geometry to meet the needs of a specific project.

The connection is adjustable in that it is capable of changing angle in situ to accommodate additional angles or manufacturing and construction tolerances during erection. More specifically, connection plates can be prefabricated by cold bending (e.g., via a press brake) to specific angles forming an assembly comprised of a small number of components that can be used for a wide variety of structural systems. For a given structure, these plates can then be further cold bent during field installation (e.g., via bolt tightening). For example, the plates could bent until turn-of-nut criteria is met. Advantages of this approach include reduced cost and construction time as prefabricated components can be used to form a wide variety of angled connections while also allowing for erection tolerances. This approach can be implemented for any moment-resisting joint between angled structural members in buildings (e.g., apex connections of portal frames) and bridges (e.g., angled connections of arch and truss bridges). Described below is an investigation of cold bending for an assembly adjustable bolted steel plate connection. The focus of this disclosure is on the geometric development of the connection and measuring the surface strains induced during field installation. This research is undertaken for a connection between flanges of wide flange structural members in double shear, but other connection orientations and/or section shapes are possible. In addition to the development of the adjustable connections, this research is relevant to cold bent plate double shear connections in general and is useful in assessing their behavior, as well as setting bend tolerances for fabrication.

Cold bending is an appealing strategy to achieve adjustability as it offers cost and time savings, as opposed to heat-assisted bending, and can be readily performed in the field. However, applications are typically limited to structural members with research involving connections primarily focused on thin-walled fastener connections, in addition to bolted lap splices and a few other types. Cold bending (for bend radii exceeding 5t, where t is the thickness) has been permitted in the bridge industry in recent years. Cold bending has been used in bridges including dapped girders, curved girder bridges, a gussetless truss bridge, and connections for large skew bridges.

The primary benefit of the invention is adjustability, both in terms of connecting members at different angles and accommodating manufacturing/construction tolerances. In conventional arch or truss bridges, these connections could join angled members, thereby avoiding gusset plates. Further, these connections could be featured in modular bridges (e.g., Pratt truss or network tied arch concepts comprised of panels) to reduce construction time. In a building environment, these connections could join members of steel portal frames.

An objective of this research is to develop a versatile adjustable bolted steel plate connection and to investigate the behavior of this connection during field installation. A geometric investigation of the adjustable plate connection was performed to select parameters for adaptability to manufacturing and erection tolerances as well as versatility of member dimensions. Full-field three-dimensional (3D) residual surface strains induced during cold bending (via a press brake) were previously measured by the inventors using Digital Image Correlation (DIC) and compared with finite element predictions. The research disclosed herein focuses on the surface strains induced in the connection during field installation (i.e., cold bending via bolt tightening). A total of 13 experimental scenarios were tested under field installation conditions, with full-field 3D surface strains measured using DIC, to investigate the effect of the (1) bolt tightening procedure, (2) amount and direction of field bending, and (3) plate angle on surface strains. This disclosure ultimately develops a novel concept for an adjustable bolted steel plate connection, measures surfaces strains induced during field installation, and makes recommendations for design and implementation.

An extensive investigation to determine optimal geometric parameters (e.g., plate length, initial plate angles, bend radii, bolt hole type, member flange thickness, member depth, and connection angle) was performed. Throughout this disclosure, the term "plate" generally refers to the plate connectors between the members. These plates connect flanges of members, which are referred to as simply "member."

FIG. 1A is an elevation view 100 of the field bending process showing an initial un-tightened connection. FIG. 1A depicts members 108 and 111 abutting at an angle to form an apex joint. The members 108 and 111 may be steel wide flange (I-shaped) sections, other types of steel sections, or of other materials, depending on the specific implementation. Member 108 includes a top flange 109 and a bottom flange 110, which extend into the page and out from the page from the perspective of the elevation view 100. Likewise, member 111 includes a top flange 112 and a bottom flange 113.

An adjustable connection includes a top plate 104 and a bottom plate 105, both of which are pre-bent along the longitudinal centerline 101 such that the top plate 104 and bottom plate 105 form inverted or non-inverted "V" or chevron shapes, in any orientation. In some instances, one or more of the top plate and the bottom plate may not be pre-bent at all, such that they are initially flat having a bend angle of 0. In FIG. 1A, the angle of the top plate 104 and bottom plate 105 is less than the angle of the apex joint of the members 108 and 111.

At first end 102, the top plate 104, top flange 109, and bottom plate 105 each include a hole that are vertically aligned such that a bolt 106 can be inserted through the aligned holes. Likewise, at the second end 103, the top plate 104, the top flange 112, and the bottom plate 105 each include a hole that are vertically aligned such that bolt 107 can be inserted through the aligned holes. When the bolts 106 and 107 are in an untightened state, gaps exist between the top plate 104, bottom plate 105, top flange 109, and top flange 112 due to the difference between the angle of the top plate 104 and bottom plate 105 and the apex joint of the members 108 and 111.

Figure 1B:
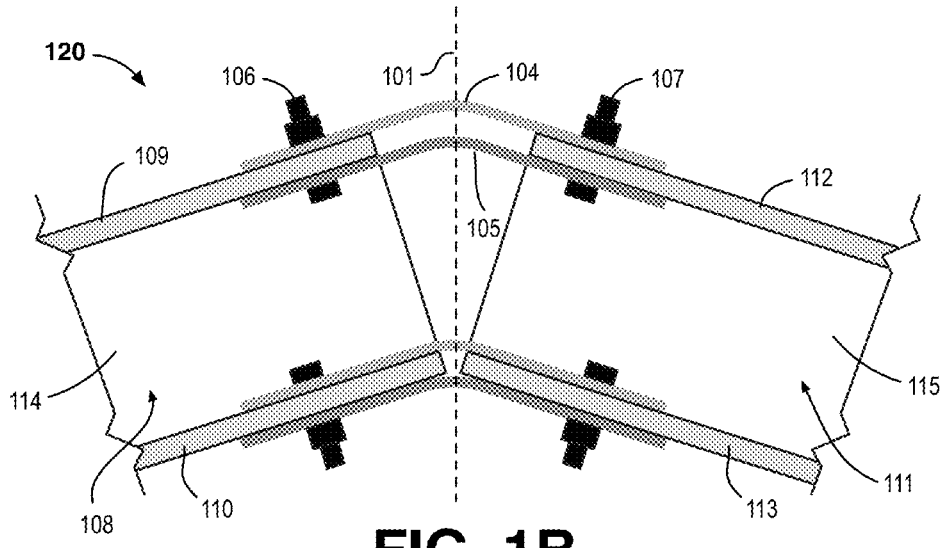
FIG. 1B is a conceptual illustration showing an elevation view of the field bending process showing a final tightened connection.
Figure 1C:
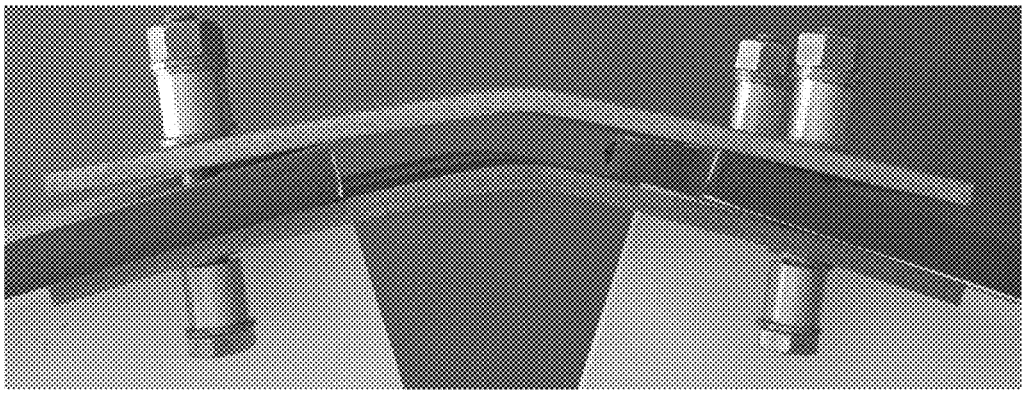
FIG. 1C is a photograph showing an elevation view of the initial un-tightened connection for Scenario 1.
Figure 1D:
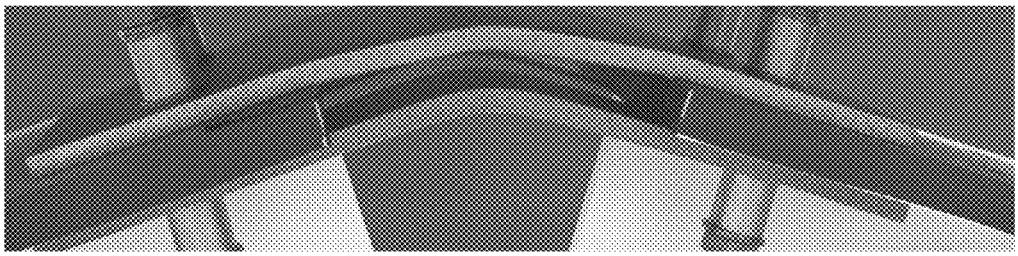
FIG. 1D is a photograph showing an elevation view of the final tightened connection for Scenario 1.

After the bolts 106 and 107 are placed through the vertically aligned holes, the bolts may be tightened in accordance with a tightening procedure (discussed in more detail below with respect to FIG. 7). The tightening procedure causes the top plate 104 and bottom plate 105 to bend along the centerline 101 as the bolts 106 and 107 exhibit increasing amounts of force on the plates 104 and 105. Once the tightening procedure is finished, as shown in FIG. 1B, the angle between the top plate 104 and the bottom plate 105 has adjusted to be substantially the same as the angle of the apex joint. FIGS. 1C and 1D photographically depict the differences between the untightened state of the adjustable connection and the tightened state of the adjustable connection, respectively.

A tightening procedure may be finished or completed once the bolts have been tightened to a threshold level of torque. As described herein, a torque wrench may be used to determine that the threshold level of torque has been met for a given tightening bolt. One of ordinary skill would appreciate that this threshold level of torque may vary, depending upon the thickness of the plate, the angle of joint, the thickness and strength of the bolts, and the thickness and strength of the members, among other factors. In some cases, a turn-of-nut criteria may be used to indicate the completion condition of a given tightening procedure. As described herein, a "threshold level of torque" may encompass other bolt tightening conditions, such as a turn-of-nut criteria.

As described herein, a "longitudinal centerline" refers to an approximate midpoint along the length of a plate, conceptually separating the plate into two opposing ends. In situations where a plate is bent, the longitudinal centerline may represent a line along which the plate is bent. Note that a bend in a plate may not be a single angle, and in some circumstances may be a continuous curve (e.g., the resulting shape of a metal plate after being bent by a press brake).

Although the example described with respect to FIGS. 1A and 1B refer to two bottom plates, other implementations may include a single bottom plate, or three or more bottom plates. For example, if member 108 is a wide flange (I-shaped) section, then top flange 109 perpendicularly abuts the vertical web 114 such that a contiguous bottom plate would collide with the web 114. In these situations, two separate bottom plates—a front bottom plate and a back bottom plate—may be placed on either side of the web 114 of member 108. A single bottom plate with an elongated slot may also be used, where the elongated slot provides space for the web 114 of the member 108. A similar bottom plate shape may be formed on the opposite end so as to fit with the web 115 of member 111.

The investigations described herein were performed for a double-shear connection in which there is a top plate and two bottom plates. However, in some cases, a single top plate or a single bottom plate may be used. Additionally, two or more bolts may be required for a given adjustable connection.

The adjustable connection is defined by the geometric parameters shown in the table 1300 of FIG. 13 and shown in FIGS. 2A-2F. For this study, the top and bottom plates are assumed to have approximately equal dimensions (aside from their width). However, the equations provided are expressed in general terms such that a designer could choose different length, angle, and radii of curvature of the top and bottom plates. Note that the thickness and hole spacing are assumed to be the same in the top and bottom plate in these equations. However, a designer could choose other dimensions and adapt the equations appropriately.

The pre-bent top and bottom plate angles ($\gamma=\beta$) are chosen to join a range of shallow angled connections. The member angle ($\alpha$) is considered in this geometric investigation for ranges of up to 5° greater than or less than the pre-bent plate angles. However, greater differences in angle are possible and are investigated experimentally. A variety of top and bottom plate lengths ($l_1=l_2$) and two different radii of curvature for the top and bottom plates ($r_t=r_b$) were investigated. The plate thickness ($t_s$) is selected to be on the order of half of the member flange thickness ($t_m$) for the considered standard rolled wide flange members (W8, W10, and W12) with depths, $d_m$. This is an appropriate proportion for the proposed double-shear connection. The hole sizes in the member ($d_{mh}$) are allowable hole sizes for oversize, short slot, and long slot types for the selected bolt diameter ($d_b$) per design code. Only oversized holes are considered for the holes in the plate ($d_{ph}$) as it will be in direct contact with the bolt head and nut. Oversized, short or long slots are necessary for the bolt up procedure. This disclosure does not address the impact of hole size on the ultimate strength of the connection. The end distance between the bolt hole centerline and the edge of the plate ($l_3$) and the edge of the member ($l_4$) is held constant. This is chosen to be more than the minimum edge distance and less than the maximum edge distance prescribed by code.

A study was performed to determine an optimized combination of the parameters. The parameters investigated include the plate lengths ($l_1=l_2$), initial plate angles ($\gamma=\delta$), plate radii of curvature ($r_b=r_t$), member slot type ($d_{mh}$), member thickness ($t_m$), member depth ($d_m$), and connection angle ($\alpha$) using the values provided in the table 1300 of FIG. 13. The description below first defines feasibility of a combination of parameters and then discusses the parametric investigation.

Figure 2A:
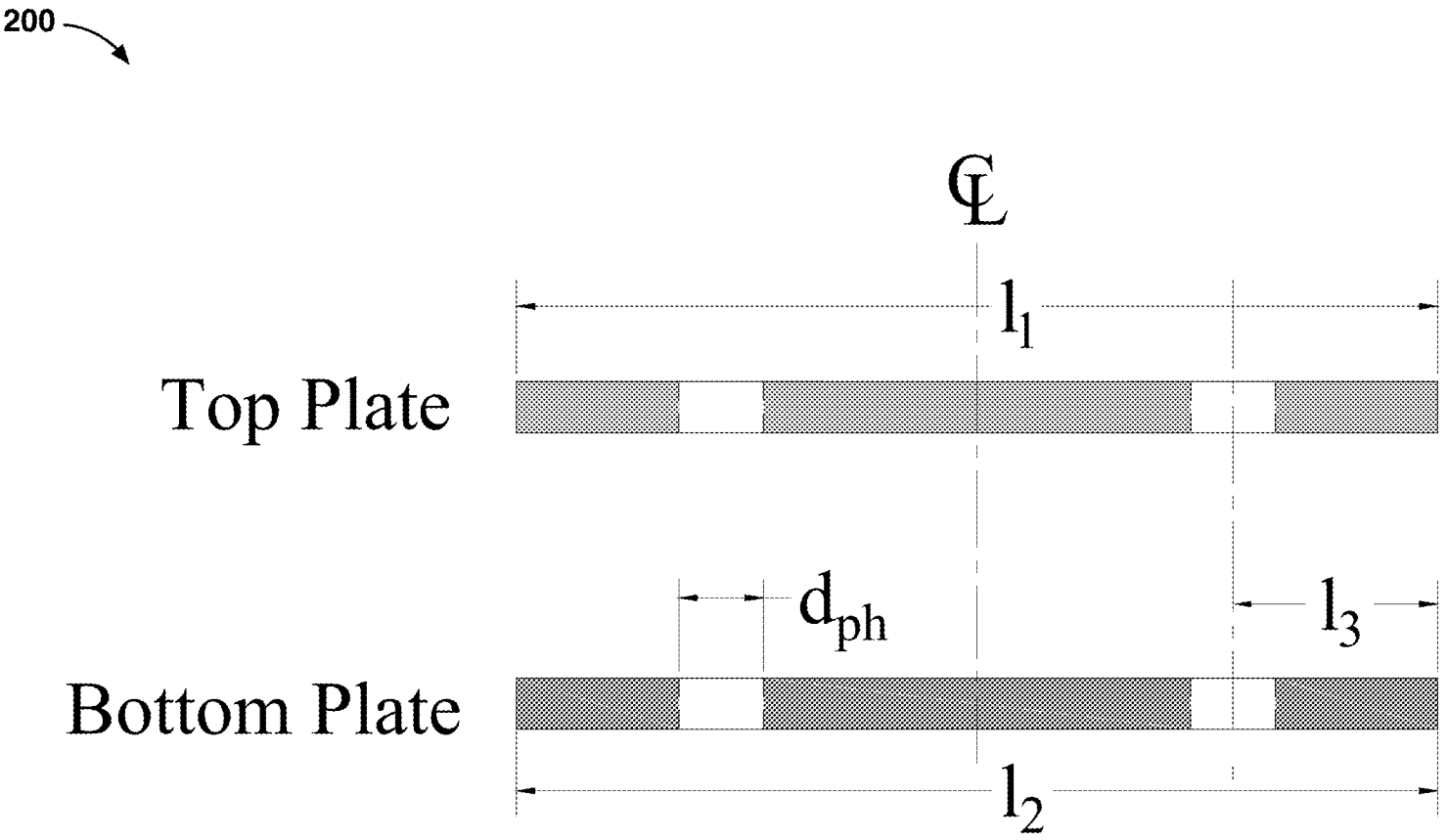
FIG. 2A is a conceptual illustration defining geometric parameters of an adjustable plate connection.
Figure 2B:
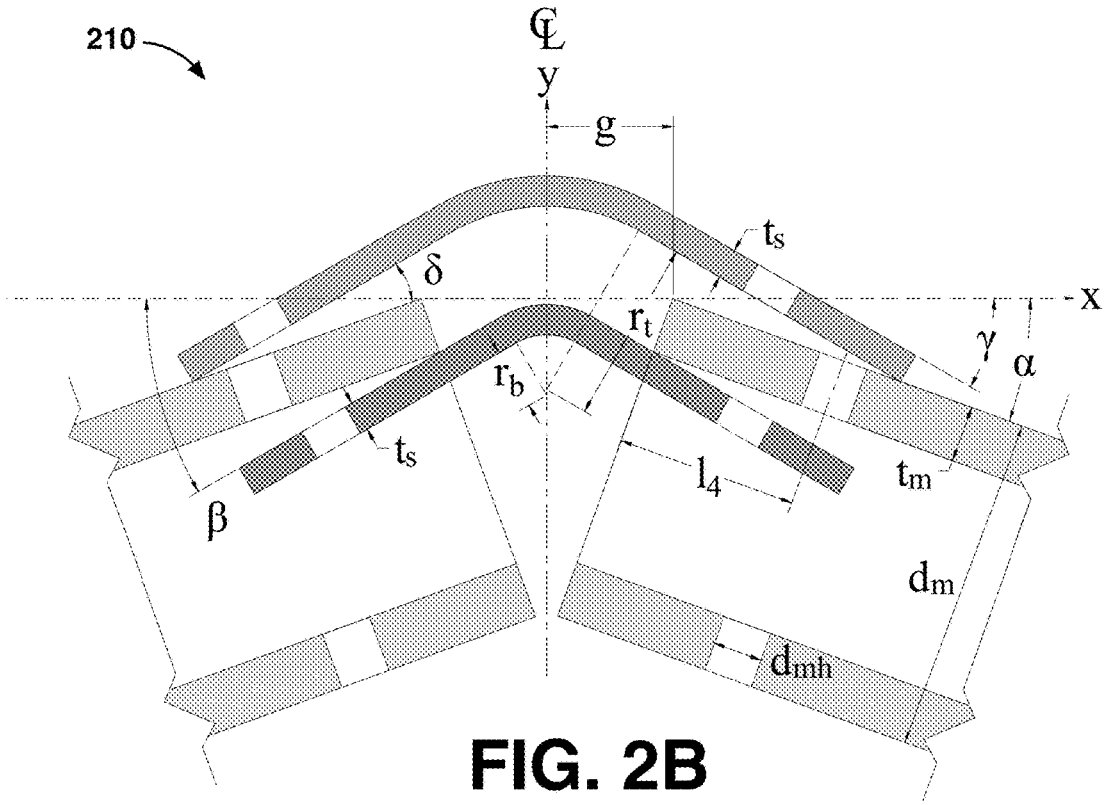
FIG. 2B is a conceptual illustration defining geometric parameters of an adjustable plate connection.
Figure 2C:
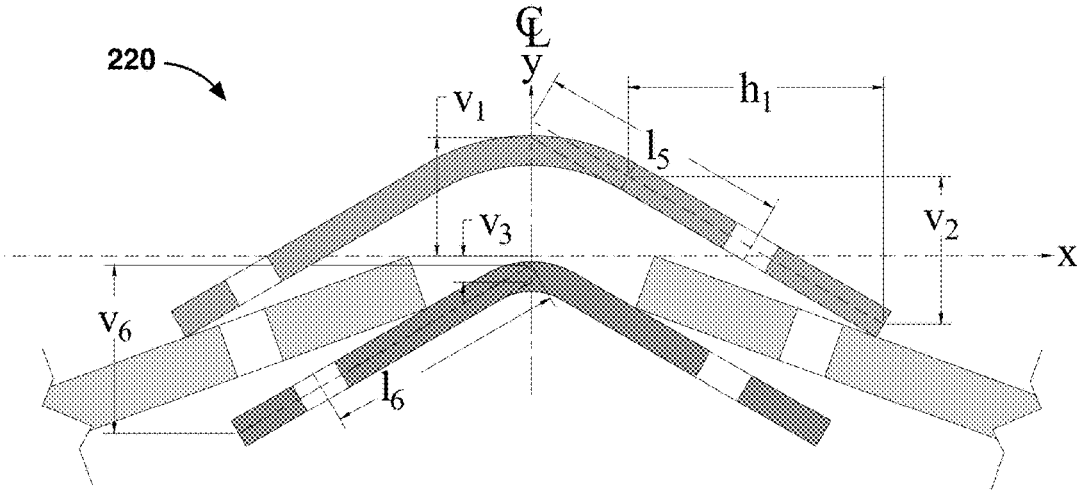
FIG. 2C is a conceptual illustration defining geometric parameters of an adjustable plate connection.
Figure 2D:
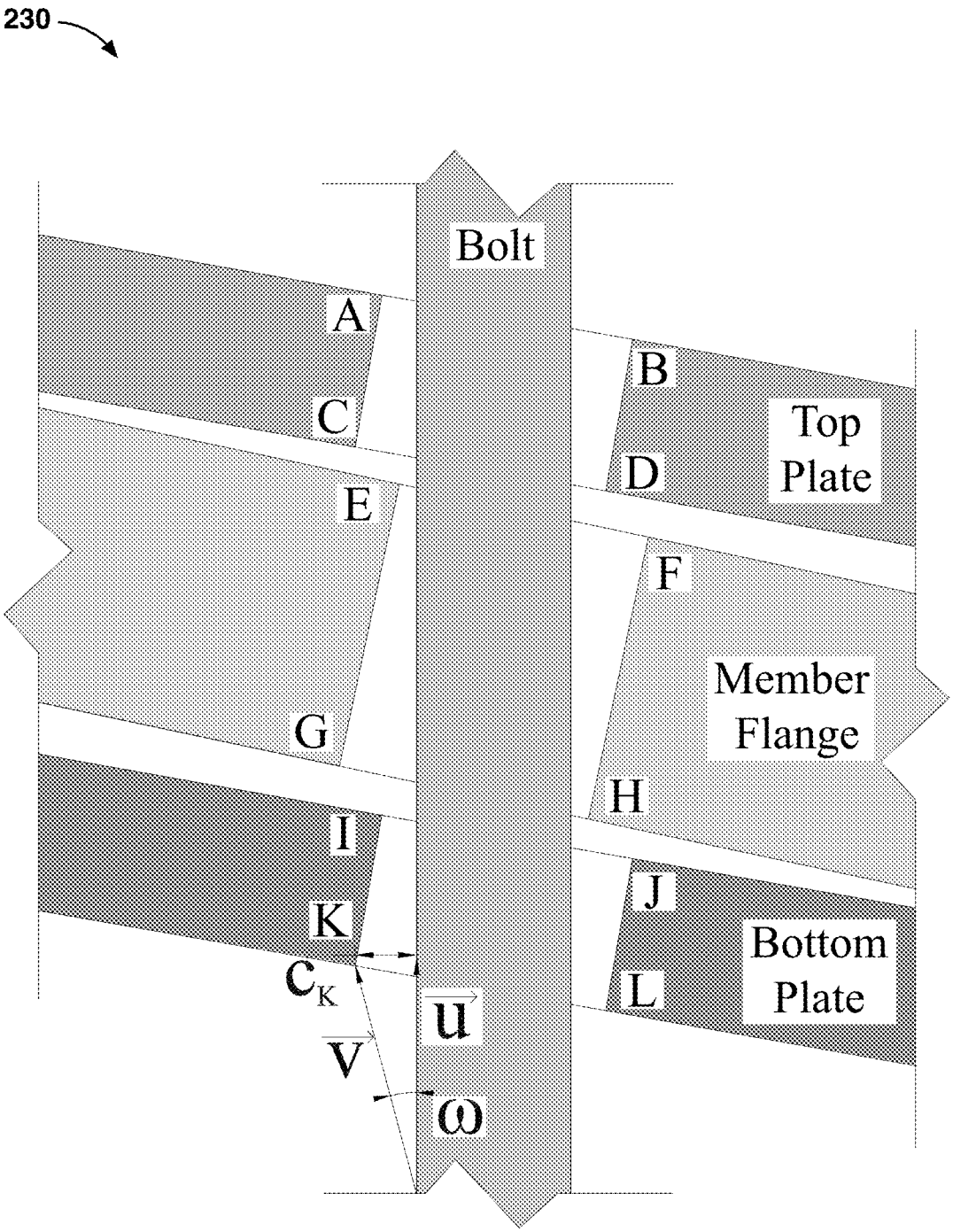
FIG. 2D is a conceptual illustration defining Locations A-L of an adjustable plate connection.
Figure 2E:
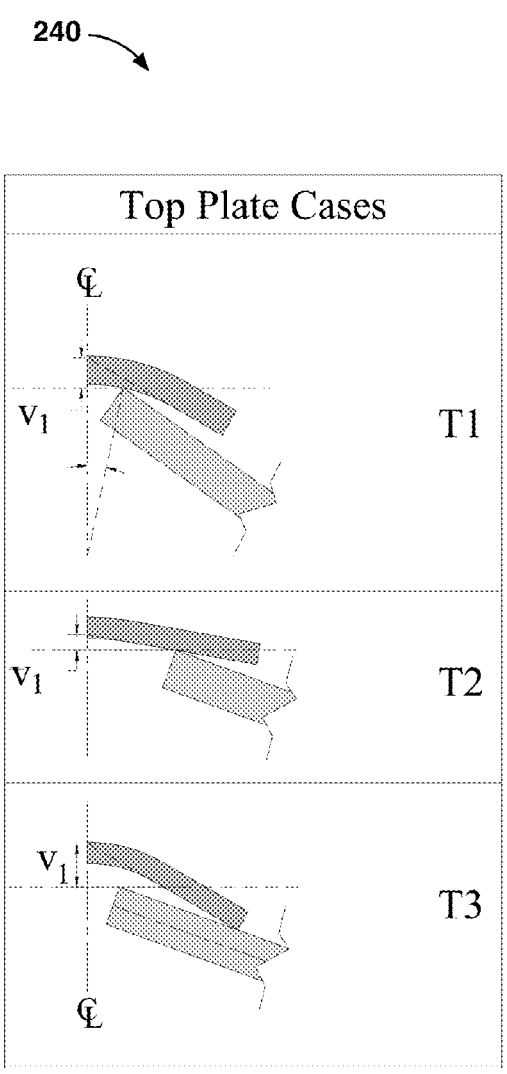
FIG. 2E is a set of conceptual illustrations defining contact case types for the top plate of an adjustable plate connection.
Figure 2F:
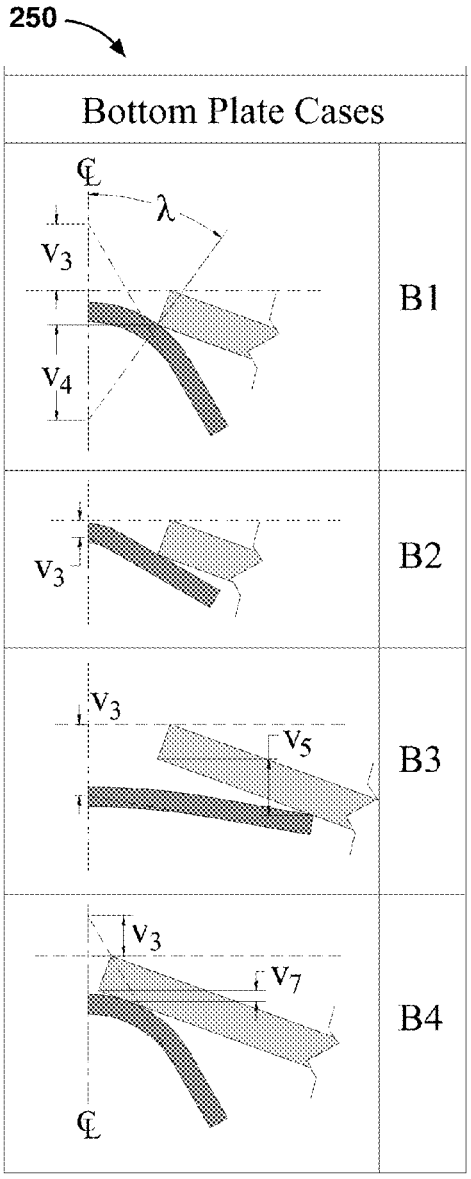
FIG. 2F is a set of conceptual illustrations defining contact case types for the bottom plates of an adjustable plate connection.

A feasible combination of geometric parameters is defined as one for which a bolt can pass through holes in the top plate, member, and bottom plate (i.e., no interference between the bolt and Locations A-L in FIG. 2D). To determine its feasibility, a comprehensive search of bolt locations was performed for all angles and lateral positions of the bolt. Starting with the bolt in a vertical orientation (i.e., parallel to the longitudinal centerline) and centered on the member hole, the clearances between the bolt and Locations A-L were calculated. The angular orientations range from where the bolt is parallel to the member in either direction (a range of 180° in increments of 1°). All lateral locations of the bolt are considered from the furthest left to the furthest right of Locations A-L [in increments of 0.397 mm (0.0156 in.)].

Bolt clearances were determined by calculating the coordinates of Locations A-L. Then, the amount of clearance (c) between the location and the bolt is:

$$c=|\vec{v}|\sin\omega \quad \text{(Eq. 1)}$$

where $\vec{v}$ is the vector from the bolt edge line ($\vec{u}$) to the location, and $\omega$ is the angle between these vectors which can be found as follows:

$$\omega=\sin^{-1}\left(\frac{\vec{u}x\vec{v}}{|\vec{u}||\vec{v}|}\right) \quad \text{(Eq. 2)}$$

The clearance is calculated for Locations A-L (equations provided below). Note that on the left side of the bolt, $\vec{u}$ is drawn pointing upward, and on the right side of the bolt, $\vec{u}$ is drawn pointing downward. A positive value of c indicates available clearance and a negative value represents lack of clearance (i.e., interference) between the bolt and plates.

Equations for Locations A-L are provided below, with subscripts x referring to the horizontal coordinate and y to the vertical coordinate with respect to the origin in FIGS. 2A-2C. All variables are defined in the table 1300 of FIG. 13 and illustrated in FIGS. 2A-2F. Angles in the equations are in units of radians and should be less than $\pi/2$. The equations shown here are for the top flange of the member, on the right side of the longitudinal centerline. Analogous equations are used for the other bolt holes.

The coordinates of Locations A-D on the top plate are as follows:

$$A_x = l_5\cos\gamma + \frac{t_s}{2}\sin\gamma - \frac{d_{ph}}{2}\cos\gamma; \quad \text{(Eq. 3)}$$

$$A_y = -\left(l_5 - \frac{t_s}{2}\tan\gamma\right)\sin\gamma + t_s\cos\gamma + v_1 + \frac{d_{ph}}{2}\sin\gamma$$

$$B_x = l_5\cos\gamma + \frac{t_s}{2}\sin\gamma - \frac{d_{ph}}{2}\cos\gamma;$$

$$B_y = -\left(l_5 - \frac{t_s}{2}\tan\gamma\right)\sin\gamma + t_s\cos\gamma + v_1 - \frac{d_{ph}}{2}\sin\gamma$$

$$C_x = l_5\cos\gamma - \frac{t_s}{2}\sin\gamma - \frac{d_{ph}}{2}\cos\gamma;$$

$$C_y = -\left(l_5 - \frac{t_s}{2}\tan\gamma\right)\sin\gamma + v_1 + \frac{d_{ph}}{2}\sin\gamma$$

$$D_x = l_5\cos\gamma - \frac{t_s}{2}\sin\gamma + \frac{d_{ph}}{2}\cos\gamma;$$

$$D_y = -\left(l_5 - \frac{t_s}{2}\tan\gamma\right)\sin\gamma + v_1 - \frac{d_{ph}}{2}\sin\gamma$$

where $l_5$ is the distance from the centerline to the top plate hole along the plate axis:

$$l_5 = \left(\frac{l_1}{2} - l_3\right) + \left(r_t + \frac{t_s}{2}\right)(\tan\gamma - \gamma) \quad \text{(Eq. 4)}$$

Length $v_1$ is measured from the origin to the extension of the plate as drawn. This is different for each contact type (FIG. 2E) for the top plate (T):

Type $T1$ if: $\alpha \geq \gamma$ and $r_t \sin\gamma \geq g$

Type $T2$ if: $\alpha \geq \gamma$ and $r_t \sin\gamma < g$

Type $T3$ if: $\alpha < \gamma$ (Eq. 5)

Length $v_1$ can be found as:

$$v_1 = \begin{cases} (r_t\sin\gamma)\tan\gamma - r_t\cos\left(\sin^{-1}\left(\frac{g}{r_t}\right)\right) - \cos\gamma & \text{if } T1 \\ g\tan\gamma & \text{if } T2 \\ r_t\sin\gamma\tan\gamma + v_2 - (r_t\sin\gamma + h_1 - g)\tan\alpha & \text{if } T3 \end{cases} \quad \text{(Eq. 6)}$$

where the vertical ($v_2$) and horizontal ($h_1$) dimensions of the straight portion of the top plate are:

$$v_2 = \left[\frac{l_1}{2} + \left(r_t + \frac{t_s}{2}\right)(\tan\gamma - \gamma) - \tan\gamma\left(r_t + \frac{t_s}{2}\right)\right]\sin\gamma \quad \text{(Eq. 7)}$$

$$h_1 = \left[\frac{l_1}{2} + \left(r_t + \frac{t_s}{2}\right)(\tan\gamma - \gamma) - \tan\gamma\left(r_t + \frac{t_s}{2}\right)\right]\cos\gamma \quad \text{(Eq. 8)}$$

The coordinates of Locations E-H on the member are as follows:

$$E_x = -g - l_4\cos\alpha + t_m\sin\alpha - \frac{d_{mh}}{2}\cos\alpha; \quad \text{(Eq. 9)}$$

-continued $$E_y = -l_4\sin\alpha + t_m\sin\alpha + \frac{d_{mh}}{2}\sin\alpha$$

$$F_x = -g - l_4\cos\alpha + t_m\sin\alpha + \frac{d_{mh}}{2}\cos\alpha;$$

$$F_y = -l_4\sin\alpha + t_m\sin\alpha - \frac{d_{mh}}{2}\sin\alpha$$

$$G_x = -g - l_4\cos\alpha - \frac{d_{mh}}{2}\cos\alpha;\ G_y = -l_4\sin\alpha + \frac{d_{mh}}{2}\sin\alpha$$

$$H_x = -g - l_4\cos\alpha + \frac{d_{mh}}{2}\cos\alpha;\ H_y = -l_4\sin\alpha - \frac{d_{mh}}{2}\sin\alpha$$

The coordinates of Locations I-L on the bottom plate are as follows:

$$I_x = l_6\cos\beta + \frac{t_s}{2}\sin\beta - \frac{d_{ph}}{2}\cos\beta; \quad \text{(Eq. 10)}$$

$$I_y = -\left(l_6 - \frac{t_s}{2}\tan\beta\right)\sin\beta + t_s\cos\beta - v_3 + \frac{d_{ph}}{2}\sin\beta$$

$$J_x = l_6\cos\beta + \frac{t_s}{2}\sin\beta + \frac{d_{ph}}{2}\cos\beta;$$

$$J_y = -\left(l_6 - \frac{t_s}{2}\tan\beta\right)\sin\beta + t_s\cos\beta - v_3 - \frac{d_{ph}}{2}\sin\beta$$

$$K_x = l_6\cos\beta - \frac{t_s}{2}\sin\beta - \frac{d_{ph}}{2}\cos\beta;$$

$$K_y = -\left(l_6 - \frac{t_s}{2}\tan\beta\right)\sin\beta - v_3 + \frac{d_{ph}}{2}\sin\beta$$

$$L_x = l_6\cos\beta - \frac{t_s}{2}\sin\beta + \frac{d_{ph}}{2}\cos\beta;$$

$$L_y = -\left(l_6 - \frac{t_s}{2}\tan\beta\right)\sin\beta - v_3 - \frac{d_{ph}}{2}\sin\beta$$

where $l_6$ is the length from the longitudinal centerline to bottom plate hole center line along the axis of the plate:

$$l_6 = \left(\frac{l_2}{2} - l_3\right) + \left(r_b + \frac{t_s}{2}\right)(\tan\beta - \beta) \quad \text{(Eq. 11)}$$

Length $v_3$ is measured from the origin to the extension of the plate as drawn. This is different for each contact type (FIG. 2F) for the bottom plate (B):

Type $B1$ if: $\alpha \leq \beta, g - t_m \sin\alpha \leq (r_b + t_s)\sin\beta$, and $\lambda \geq \alpha$ Type $B2$ if: $\alpha \leq \beta$ and $g - t_m \sin\alpha > (r_b + t_s)\sin\beta$ Type $B3$ if: $\alpha > \beta$ Type $B4$ if: $\alpha \leq \beta, g - t_m \sin\alpha \leq (r_b + t_s)\sin\beta$, and $\lambda < \alpha$ (Eq. 12)

where $\lambda$ is the angle from the center of curvature of the bottom plate to the point of contact with the member:

$$\lambda = \sin^{-1}\left(\frac{g - t_m\sin\alpha}{r_b + t_s}\right) \quad \text{(Eq. 13)}$$

Length $v_3$ can be found as:

$$v_3 = \quad \text{(Eq. 14)}$$

-continued $$\begin{cases} -r_b\cos\beta - r_b\sin\beta\tan\beta + \frac{t_m}{\cos\alpha} + v_4 & \text{if } B1 \\ t_m\cos\alpha + \frac{t_s}{\cos\beta} - (g - t_m\sin\alpha)\tan\beta & \text{if } B2 \\ \frac{t_s}{\cos\beta} + v_5 + \frac{t_m}{\cos\alpha} - v_6 & \text{if } B3 \\ -r_b\cos\beta - r_b\sin\beta\tan\beta + t_m\cos\alpha + v_7 + (r_b + t_s)\cos\alpha & \text{if } B4 \end{cases}$$

where $v_4$ is the vertical distance from the center of curvature of the bottom plate to the member contact location for case B1. Length $v_4$ is defined as follows:

$$v_4 = \sqrt{(r_b + t_s)^2 - \left(\frac{g - t_m\sin\alpha}{2}\right)^2} \quad \text{(Eq. 15)}$$

The vertical distance between the contact point and the bottom corner of the member ($v_5$) for contact case B3 is:

$$v_5 = \left(\frac{\frac{l_2}{2} + \left(r_b + \frac{t_s}{2}\right)(\tan\beta - \beta)}{2}\cos\beta + \frac{t_s}{2}\sin\beta - g + t_m\sin\alpha\right)\tan\beta \quad \text{(Eq. 16)}$$

The vertical dimension of the bottom plate ($v_6$) for contact case B3 is:

$$v_6 = \frac{\frac{l_2}{2} + \left(r_b + \frac{t_s}{2}\right)(\tan\beta - \beta)}{2}\sin\beta \quad \text{(Eq. 17)}$$

The vertical distance between the contact point and the bottom corner of the member ($v_7$) for contact case B4 is:

$$v_7 = ((r_b + t_s)\sin\beta - g + t_m\sin\alpha)\tan\alpha \quad \text{(Eq. 18)}$$

A parametric investigation was performed. The first level varies the member angle ($\alpha$) and gap (g) between the members to determine the range of member connection angles and the minimum and maximum gap that are feasible for a given configuration. It is advantageous for the connection to achieve the widest range of member connection angles and to span the widest range of gaps between members to accommodate erection tolerances on both the angular and lateral placement of members.

For combinations of parameters of a and g, the feasibility of the configuration was evaluated for (1) member angles ($\alpha$) plus or minus 5° of the pre-bent splice plate angles ($\gamma=\delta$) in 0.5° increments and (2) gaps (g) between a lower-bound based on a selected minimum clearance (e) and an upper-bound based on plate lengths ($l_1=l_2$).

Figure 3A:
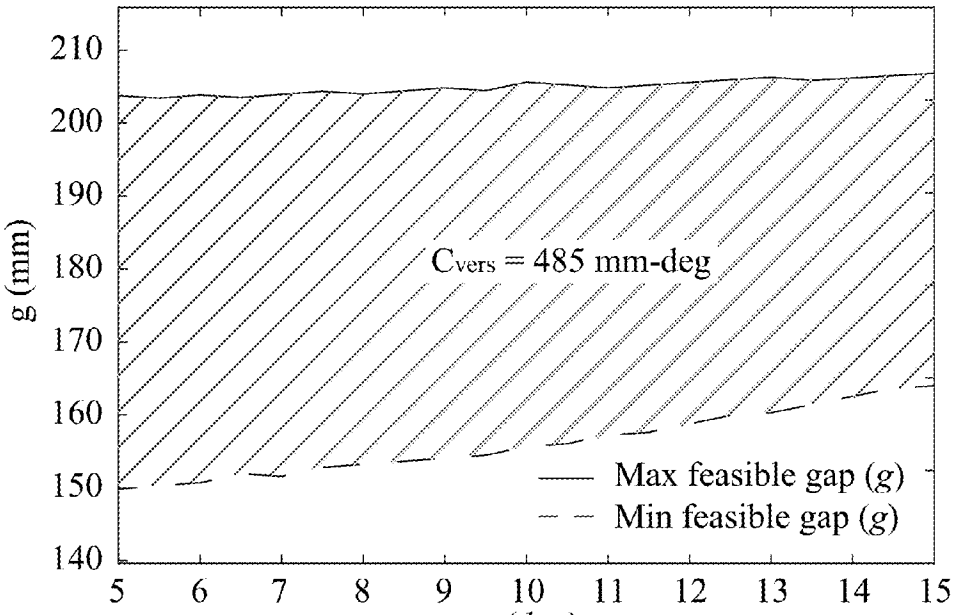
FIG. 3A is a graph showing representative Level 1 geometric analysis considering connection angle ($\alpha$) and gap (g).

From a representative Level 1 analysis (FIG. 3A), it is shown that with higher member angles ($\alpha$) the range of allowable gap (g) is reduced. As a measure of the erection versatility, the area between the two lines indicating the minimum and maximum gap is calculated and recorded as $C_{vers}$ (shaded region in FIG. 3A) to be used in upper level geometric analyses.

A second level analysis considers the sensitivity of $C_{vers}$ to varying member thicknesses ($t_m$) and member depth ($d_m$). This relates to the versatility of a design, allowing for the widest range of member sizes for a given configuration.

Figure 3B:
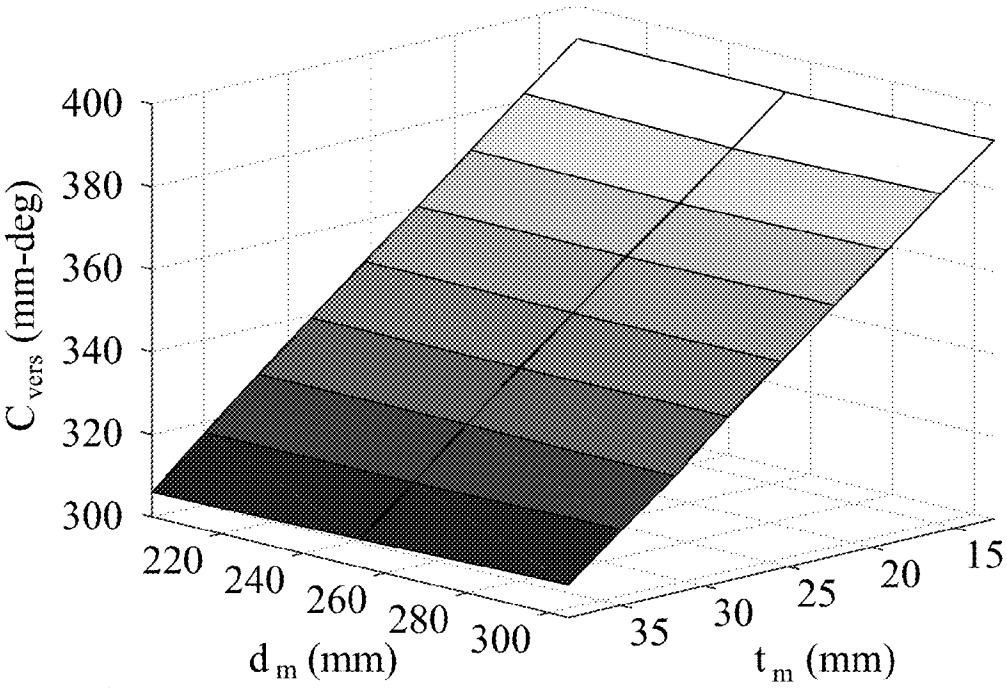
FIG. 3B is a graph showing a representative Level 2 geometric analysis considering member depth ($d_m$) and member thickness ($t_m$).

A representative Level 2 analysis (FIG. 3B) shows that with lower member flange thicknesses ($t_m$) there is greater versatility ($C_{vers}$) than with higher member flange thicknesses. The considered member depths ($d_m$) have little effect on versatility. The volume beneath the surface of this plot is calculated and recorded as $D_{vers}$ as a measure of the design versatility of the specified configuration to be used in upper level analyses.

The third level of analysis considers the metric $D_{vers}$ for a variety of plate lengths ($l_1=l_2$) and initial plate angles ($\gamma=\delta$), as connections with higher angles require longer plates.

Figure 3C:
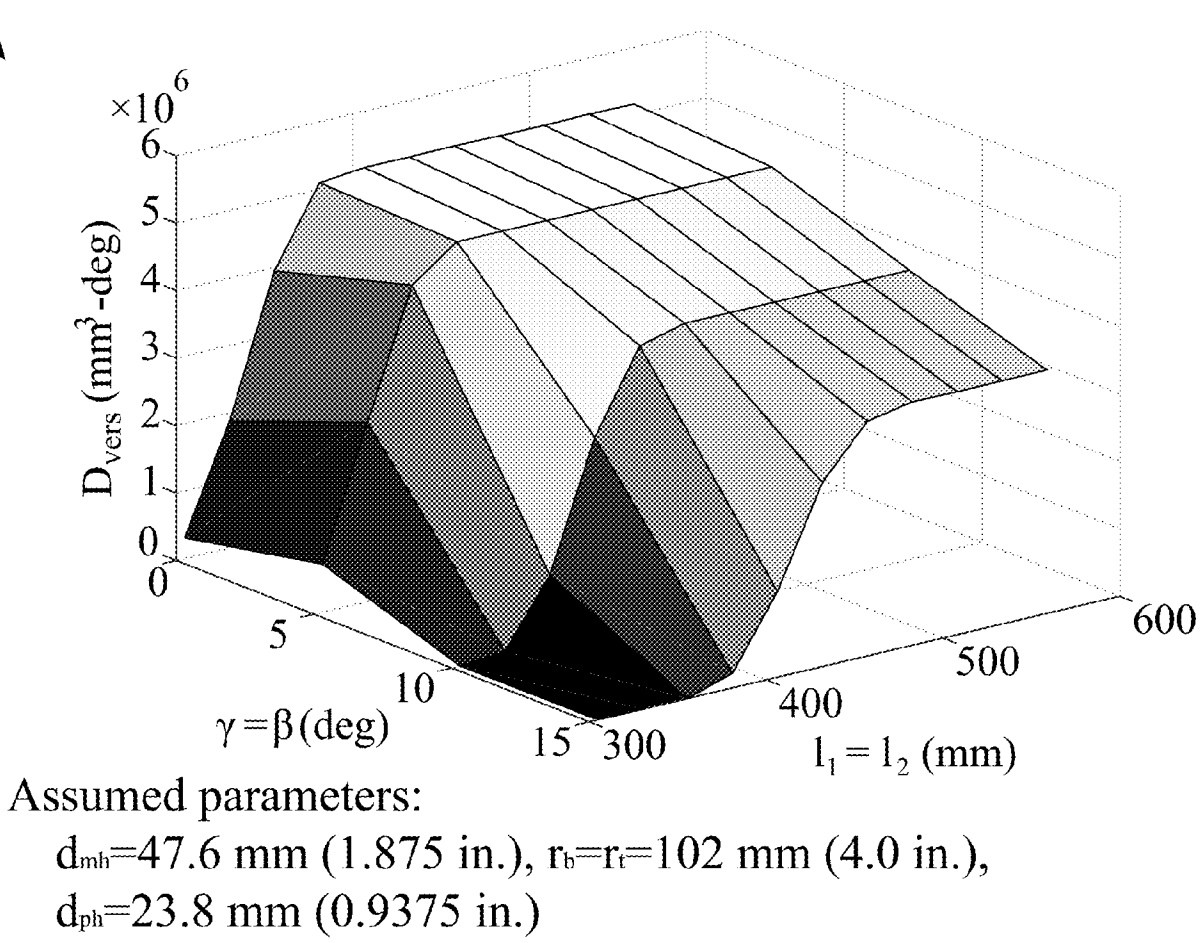
FIG. 3C is a graph showing a representative Level 3 geometric analysis considering plate length ($l_1=l_2$) and initial plate angle ($\gamma=\beta$).

A representative Level 3 analysis (FIG. 3C) shows that, up to a point, an increase in versatility can be achieved by increasing plate length. This is because the longer plate lengths allow deeper members to be connected without causing interference of the bottom flanges. To a lesser degree it is shown that increasing plate angles ($\gamma=\delta$) decreases versatility, as is expected because the increased angles minimize available space for bolts to pass through the connection.

The fourth level analysis considers the radii of curvature ($r_t=r_b$) and member hole types ($d_{mh}$). The radii of curvature considered were 63.5 mm (2.5 in.) and 102 mm (4 in.). The former corresponds to the 5t minimum bend radii allowed by bridge design code. The member hole types considered include oversized holes, short slots, and long slots.

Figure 3D:
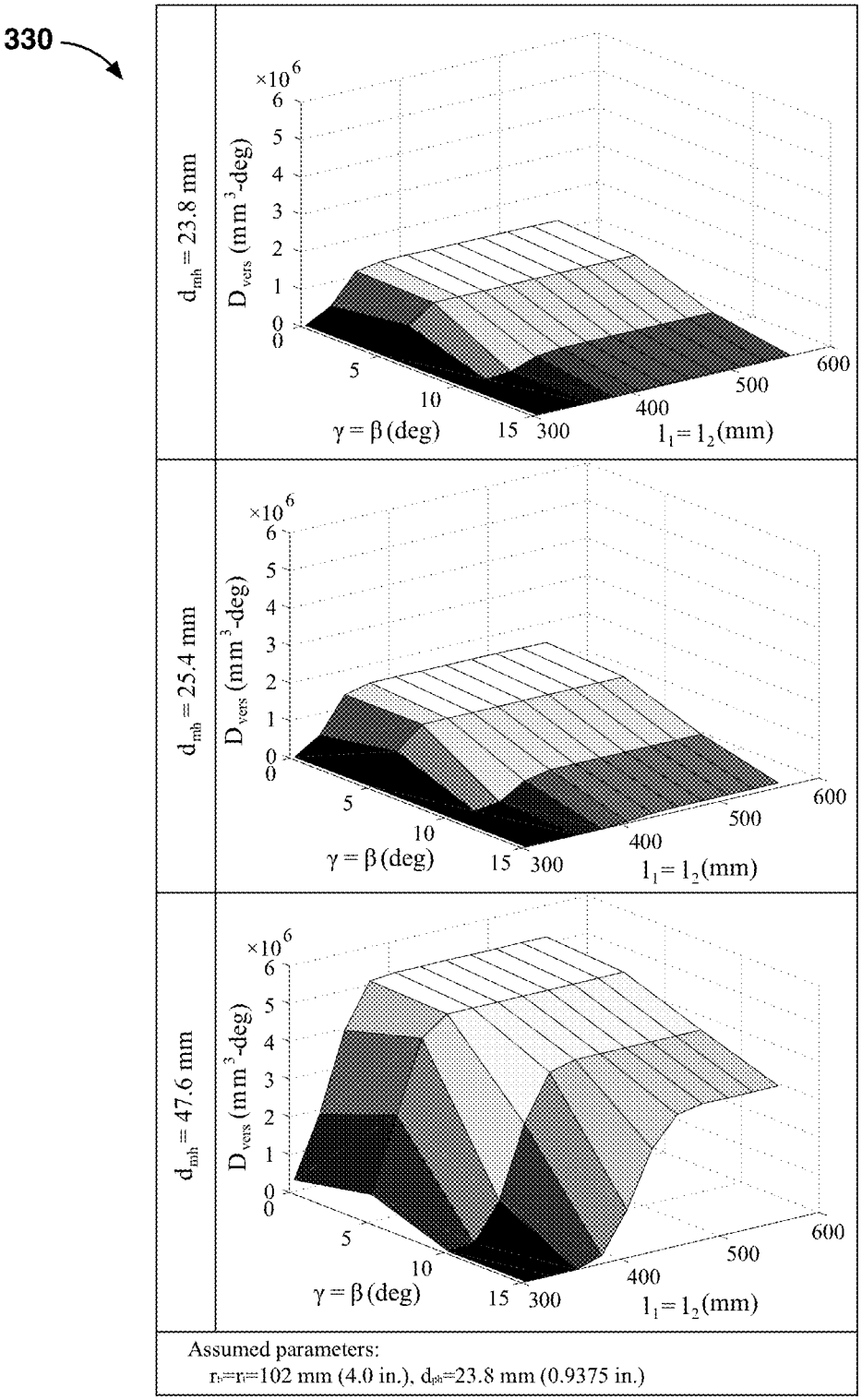
FIG. 3D is a graph showing a representative Level 4 analysis considering member hole type ($d_{mh}$).

This analysis repeats the Level 3 studies 6 times to evaluate all considered combinations of radii and member hole types. Results for $r_t=r_b=102$ mm (4 in.) are shown in FIG. 3D. Results for the smaller bend radius are not included as it was found that the value for the radius of curvature does not play a significant role in versatility. This is because in many configurations, the member contacts the straight portion of the plate resulting in the radius of curvature having a minor impact on the geometric analysis. It is shown that a significant improvement in versatility can be achieved through the use of long slots in the member, but short slots are very similar to oversized holes.

The geometric parameters of the connection investigated in the experimental program were chosen based on the results of these studies. From the results of the Level 1 study (FIG. 3A), it was found that higher member angles result in more stringent gap ranges to achieve feasibility. In the Level 2 study (FIG. 3B), it was found that thicker member flanges result in reduced versatility, but member depth had little impact on versatility. The Level 3 study (FIG. 3C) indicates that longer plates allow for deeper members to be connected by preventing interference of the bottom flange. From the Level 4 study (FIG. 3D), it was found that the considered radii of curvature had little impact on the geometric analysis, and that longer slots in the member can dramatically increase the connection's versatility.

Figure 4A:
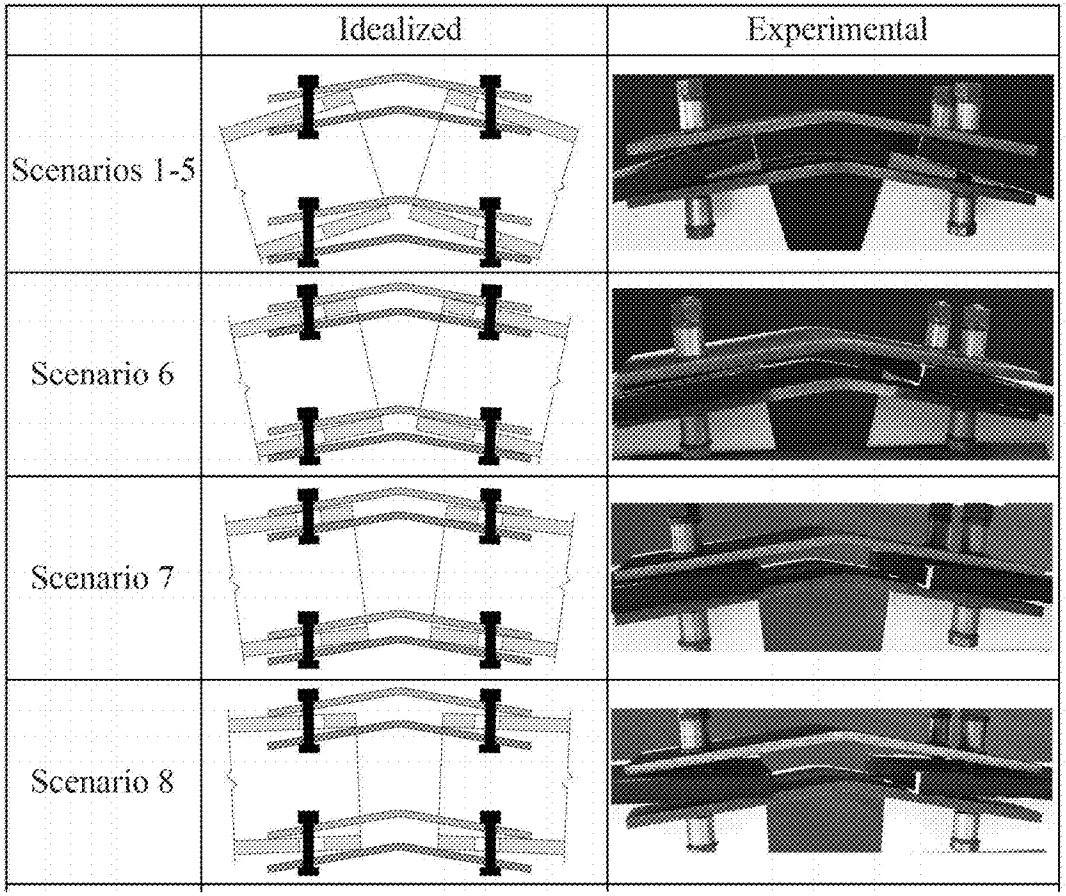
FIG. 4A is a table illustrating idealized and experimental plate bending for Scenarios 1-8.
Figure 4B:
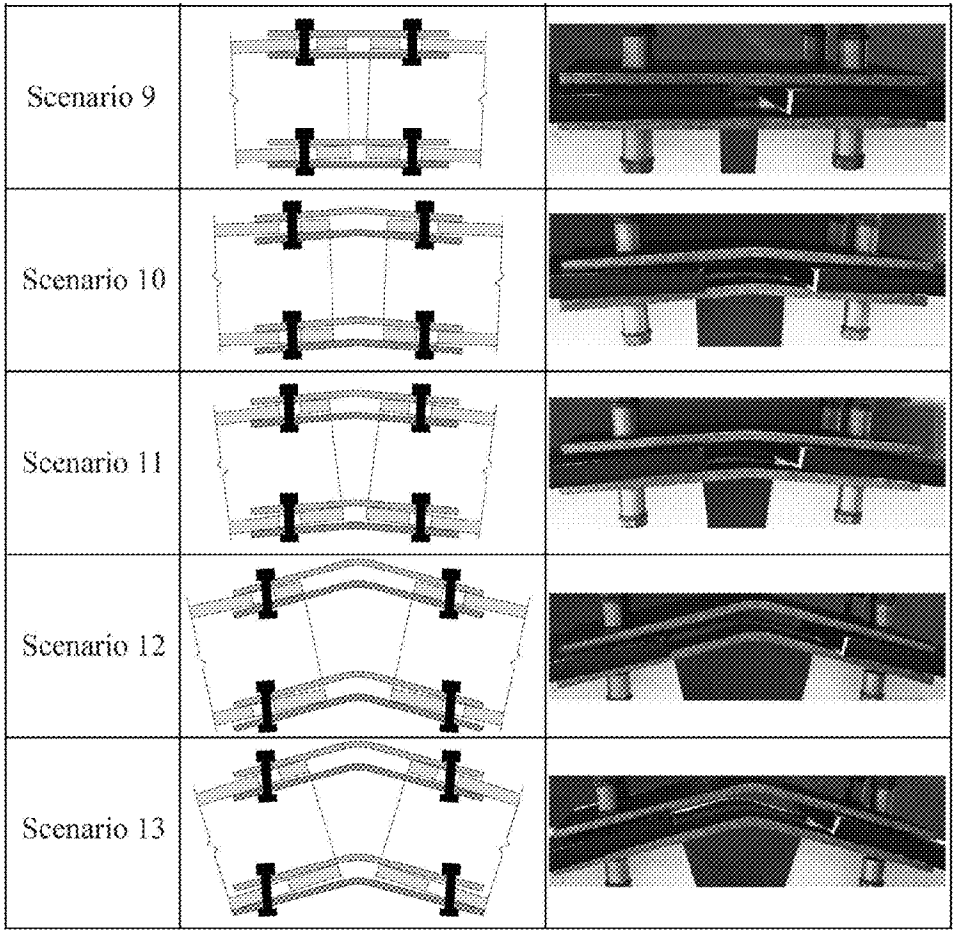
FIG. 4B is a table illustrating idealized and experimental plate bending for Scenarios 9-13.

Based on these studies, the member hole type is taken as a long slot [$d_{mh}$=47.6 mm (1.875 in.)] to ensure the widest variety of feasible geometry. A 102 mm (4 in.) radius of curvature ($r_b=r_t$) was chosen as the radius does not significantly affect the versatility of the connection and larger bend radii reduce the magnitude of residual strains from prefabrication. The plate lengths ($l_1=l_2$) were chosen for specific plate angles ($\gamma=\delta$) to achieve high versatility ($D_{vers}$). For $\gamma=\beta=0°$, $l_1=l_2=381$ mm (15 in.); for $\gamma=\beta=5°$, $l_1=l_2=432$ mm (17 in.); for $\gamma=\beta=10°$, $l_1=l_2=483$ mm (19 in.); for $\gamma=\beta=15°$ plates, $l_1=l_2=533$ mm (21 in.). These values indicate one option for this connection, but a designer could choose other values. Note that the standard threaded length of A325 bolts can induce limitations for connections with high magnitudes of angle difference between the plate and member, as they require a significant threaded length to fully tighten the connection. FIGS. 4A-4B show the idealized geometry from this study and the as-built implementation, verifying this geometric study and highlighting its robustness.

A total of 13 connection scenarios were tested to investigate the effect of the (1) bolt tightening procedure, (2) amount and direction of field bending, and (3) plate angle on the surface strains of the plates induced during field installation (table 1400 shown in FIG. 14, FIGS. 4A-4B). Scenario 1 was tested three times to demonstrate repeatability. All other scenarios were tested once. In all figures and discussion, negative strains correspond to compression and positive strains to tension.

Figure 5A:
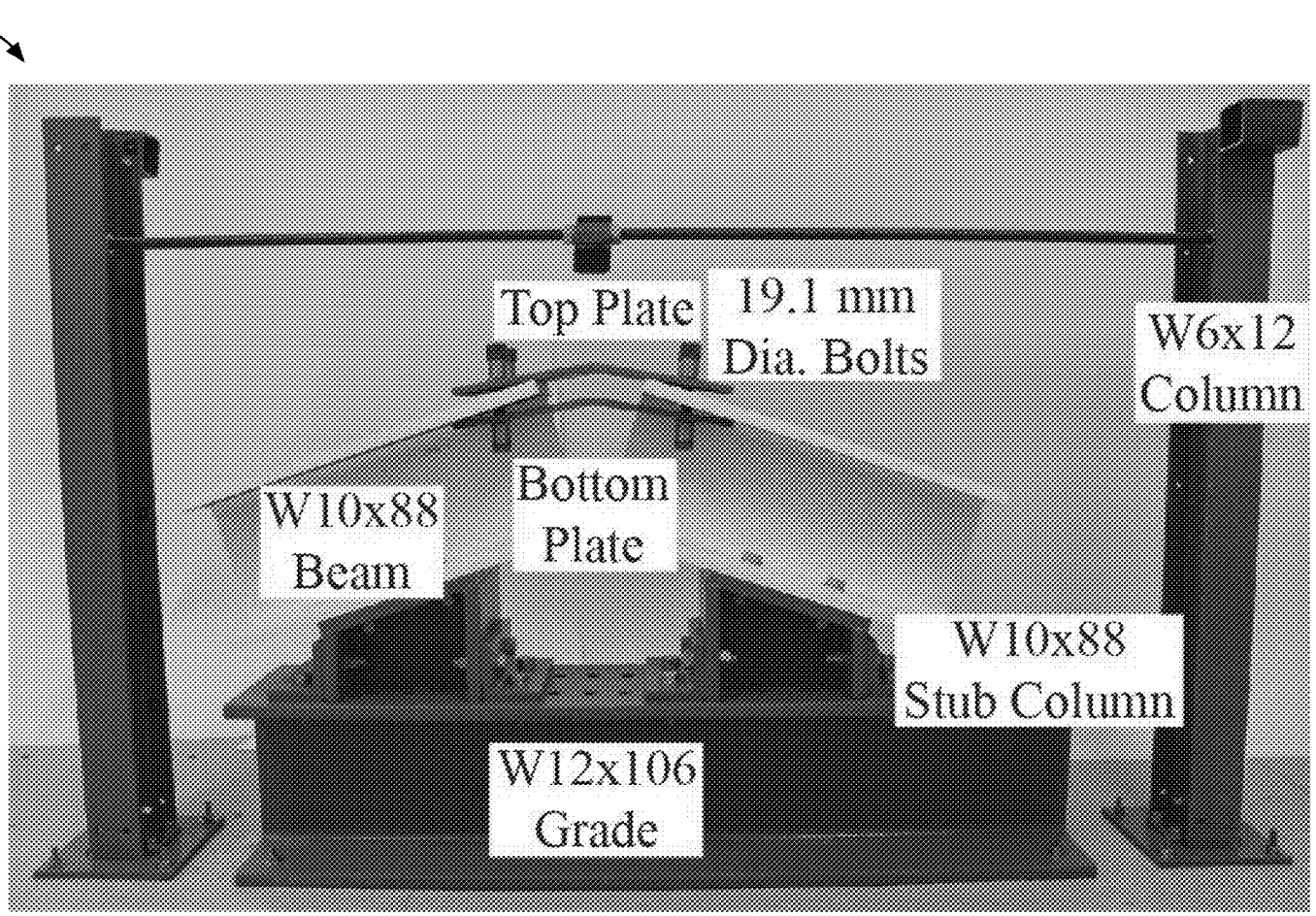
FIG. 5A is a photograph showing an elevation view of the experimental test setup for Scenario 1.
Figure 5B:
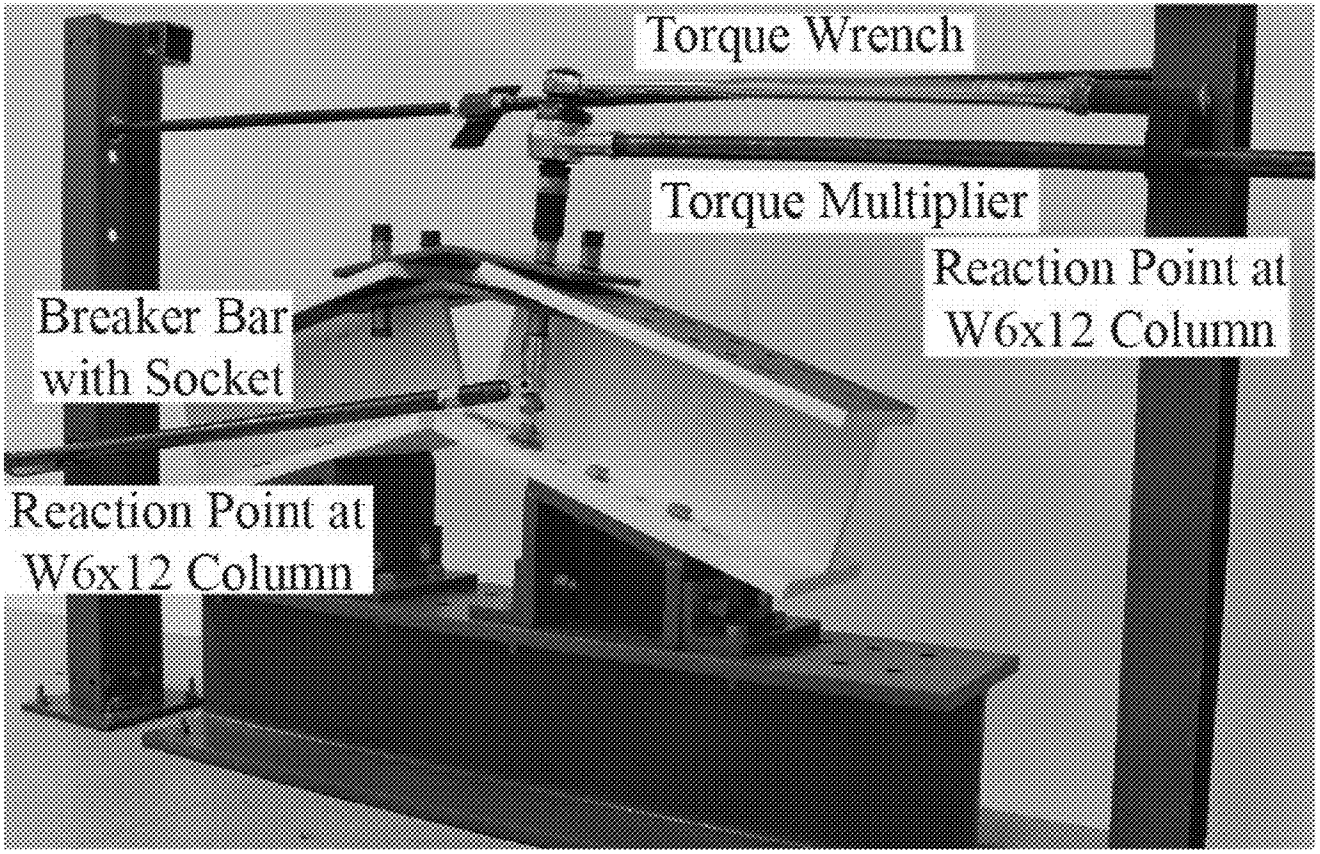
FIG. 5B is a photograph showing the bolt tightening tools used for Scenario 1.
Figure 5C:
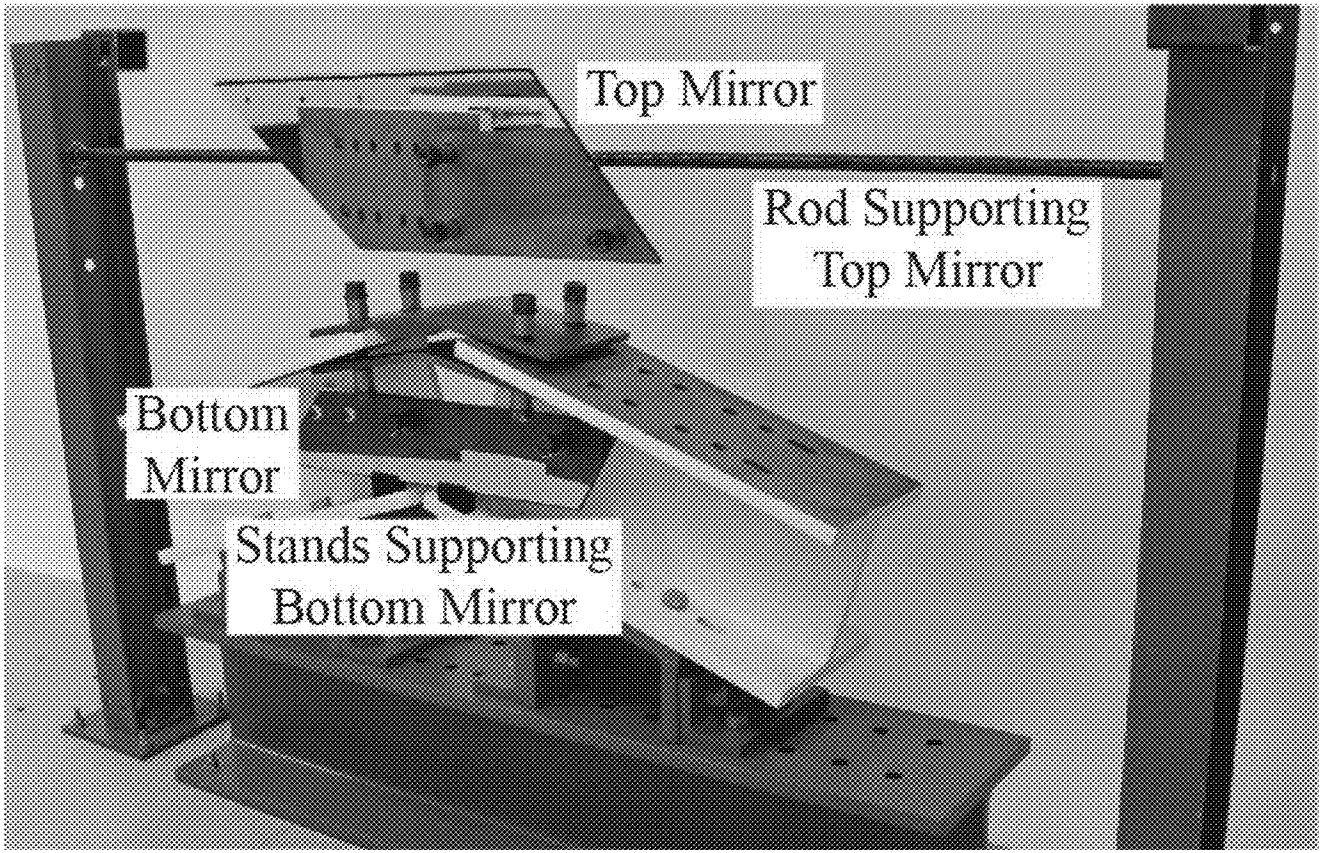
FIG. 5C is a photograph showing the instrumentation support system for Scenario 1.

Each scenario used three ASTM A36 steel plates to connect the top flanges of two W10×88 beams (see FIGS. 5A-5C). A single top plate [12.7 mm (0.500 in.) thick by 203 mm (8.00 in.) wide with lengths varying from 381 to 533 mm (15.0 to 21.0 in.)] connected the top surface of the top flanges, while two bottom plates [12.7 mm (0.500 in.) thick by 76.2 mm (3.00 in.) wide with lengths varying from 381 to 533 mm (15.0 to 21.0 in.)] connected the underside of the top flanges, with one bottom plate located on each side of the web of the beams. The plates were pre-bent via a press brake. Each connection used four ASTM A325 19.1 mm (0.750 in.) diameter bolts.

Each W10×88 beam was supported by a W10×88 stub column connected to a W12×106 grade beam that was anchored to the laboratory floor (see FIGS. 5A-5C). Different stub columns were used to vary the angle of the beams. Bolts were tightened via a torque wrench, with the assistance of a torque multiplier (see FIG. 5B). One W6×12 cantilevered column was located at each end of the test setup and bolted to the laboratory floor. These columns provided a reaction point for the tools used to tighten the bolts and support the instrumentation system (see FIGS. 5B and 5C). FIGS. 4A-4B shows the idealized geometry as well as the experimental setup for each tested scenario. In all scenarios the bolts fit into the assembly as anticipated, verifying the accuracy of the geometric study.

The full-field surface strains in the plates were measured using 3D DIC, a non-destructive and non-contact optical technique. The DIC system consisted of two cameras [2448×2050 pixels with 12.0 mm (0.472 in.) manual focus lenses] and utilized optical analysis DIC software to measure surface strains on patterned specimens within the field-of-view (FOV). The plate specimens were patterned by first coating them with paint and then etching them with a random pattern using a laser cutter. Stereo pairs of photographic images of patterned specimens were captured before, during, and after prefabrication and field installation. Multiple camera positions and mirrors were used to capture the behavior of the top surface of the top plate and bottom surfaces of both bottom plates (FIG. 5C). The FOV for each position was approximately 610 by 510 mm (24.0 by 20.1 in.). The captured images were divided into regions called facets that are 13 by 13 pixels. Using photogrammetric triangulation and pattern recognition, these facets were tracked through a series of images to produce 3D full-field surface strains. Overall, the system is capable of measuring strains up to 0.0001 mm/mm (0.0001 in./in.).

The following text focuses on the impact of the bolt tightening procedure on the surface strains induced in the plates during field installation. As shown in table 1400 of FIG. 14, five different bolt-tightening procedures were investigated (Scenarios 1-5) when bending plates from $\gamma=\beta=10°$ to $\alpha=17.5°$. The difference between plate angles ($\gamma=\delta$) and member angles ($\alpha$) is defined as $\delta$, and considered positive when plate angles are less than the member angle (e.g., for Scenarios 1-5, $\delta=+7.5°$). For each scenario, the connection was considered fully tightened when the turn-of-nut criteria was satisfied for each individual bolt.

Figure 6:
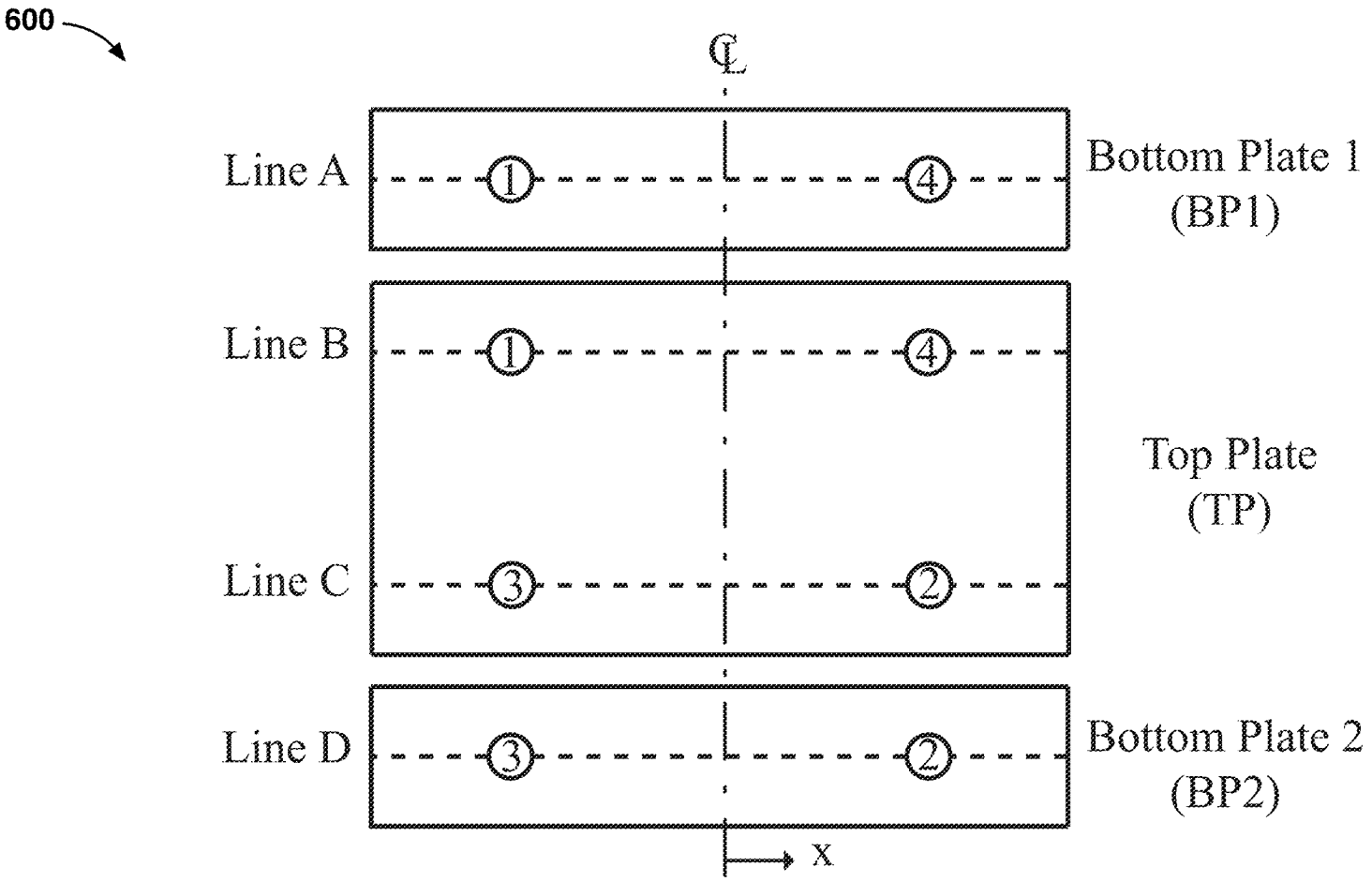
FIG. 6 is an illustration showing the longitudinal and lateral centerlines and bolt locations for an adjustable plate connection.

FIG. 6 shows a plan view of the top and bottom plates and indicates four lateral lines for which data will be presented: Line A is the lateral centerline of bottom plate 1 (BP1), Line B intersects the top row of bolts for the top plate (TP), Line C intersects the bottom row of bolts for the top plate, and Line D is the lateral centerline of bottom plate 2 (BP2).

Figure 7:
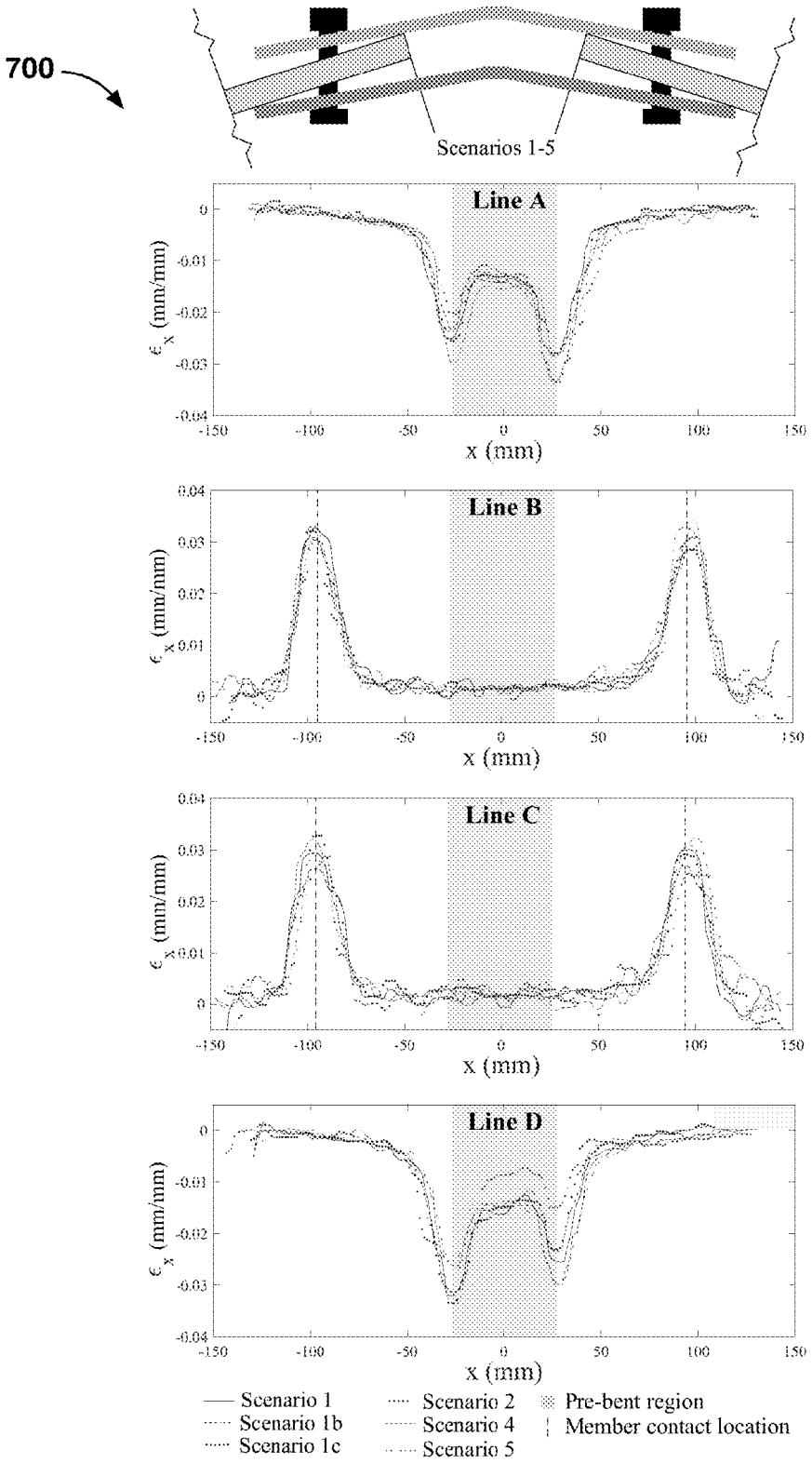
FIG. 7 is a set of graphs showing effects of bolt tightening procedures on the circumferential strains.

FIG. 7 illustrates a set of graphs showing effects of bolt tightening procedures, including measured circumferential surface strain ($\epsilon_x$) along Lines A-D identified in FIG. 6. Scenario 1 tightens in a criss-cross pattern (1-2-3-4) with 1 full turn of each bolt per tightening increment, Scenario 2 tightens in a criss-cross pattern with 3 full turns of each bolt per increment. Scenario 4 tightens in a clockwise circular pattern (1-4-2-3) and Scenario 5 tightens in a counter-clockwise circular pattern (4-1-3-2), both with 1 full turn of each bolt per increment.

In FIG. 7, the measured circumferential surface strains ($\epsilon_x$) are a function of the location along Lines A-D for Scenarios 1, 2, 4, and 5. The magnitudes of strains are very similar in both the top and bottom plates [around 0.03 mm/mm (0.03 in./in.)] for all scenarios. As expected, the peak strains in the top plate occur near the point of contact with the beams (shown as dashed vertical lines) and have relatively narrow widths [approximately 30 to 40 mm (1.2 to 1.6 in)]. The peak strains in the bottom plates occur at the edge of the pre-bent region (indicated by the gray-shaded region). These peaks are on the edges of the pre-bent region which has been work hardened and therefore has a higher yield strength as opposed to the straight portions of the plate. There are also strains measured throughout the pre-bent region, as the bottom plates behave similar to a beam under four-point bending.

The measured strains from the three tests of Scenario 1 (identified as Scenarios 1a, 1b, and 1c) were very similar, demonstrating that the connection assembly and bolt tightening procedure are repeatable.

Figure 8:
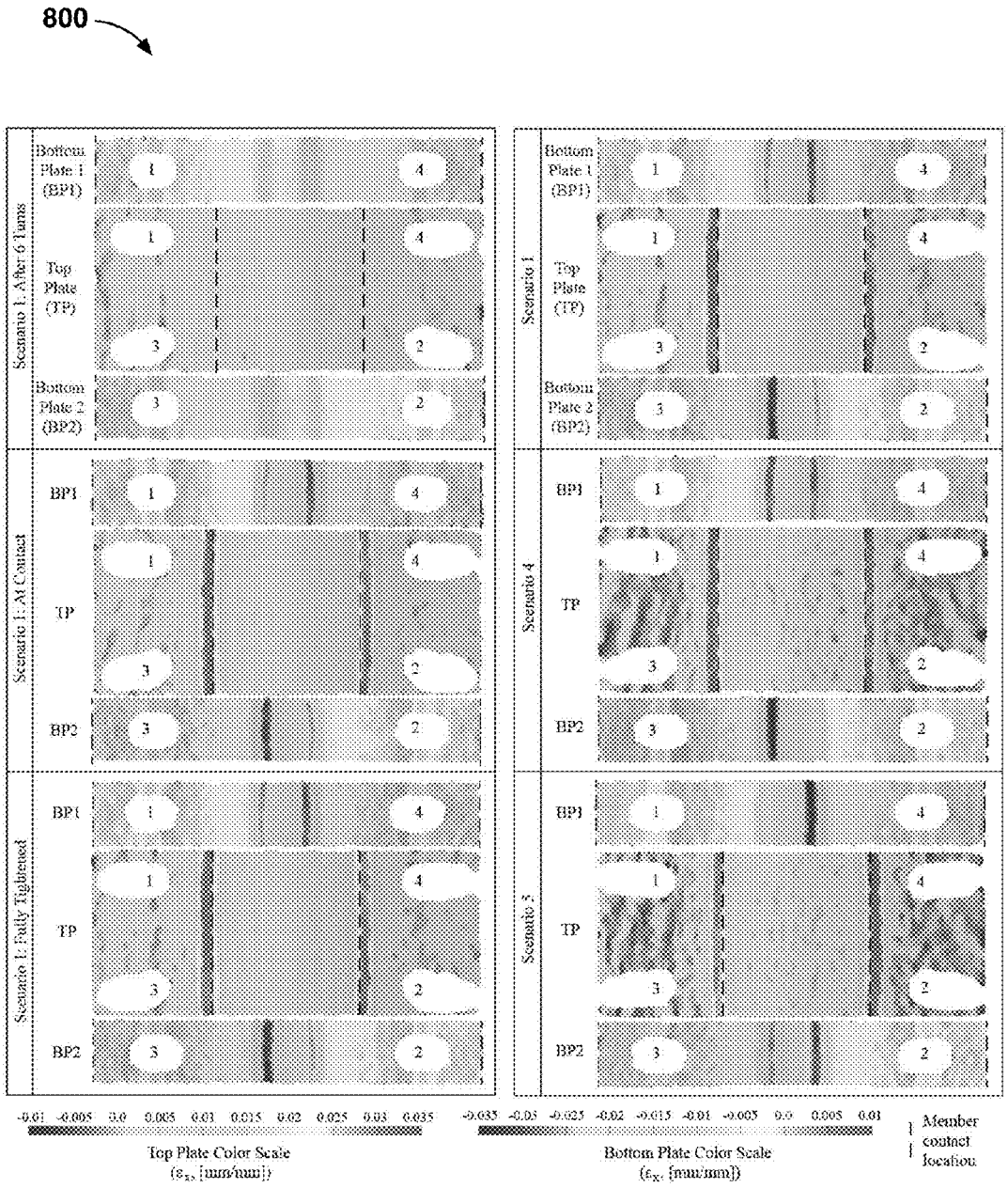
FIG. 8 is a set of full field circumferential strain maps showing the effect of bolt tightening procedures.

FIG. 8 is a set of full field strain maps showing the effect of bolt tightening procedures on measured circumferential surface strain ($\epsilon_x$). The left column indicates the evolution of strains during tightening for Scenario 1, which tightens in a criss-cross pattern (1-2-3-4). The right column indicates the fully tightened strains for Scenario 4, which tightens in a clockwise circular pattern (1-4-2-3), and for Scenario 5, which tightens in a counterclockwise circular pattern (4-1-3-2). All use 1 full turn of each bolt per tightening increment. Numbers indicate bolt identification.

The left column of FIG. 8 shows the progression of strain during the bolt tightening process of Scenario, while the right column shows the final strain induced by the bolt tightening procedures of Scenarios 1, 4, and 5 (criss-cross, clockwise, and counter-clockwise, respectively). FIG. 8 (left) shows the full-field surface strains within the DIC FOV in the top and bottom plates for Scenario 1, with the measured results shown after six turns of each bolt, at the point of contact between the plates and the beams, and after the final turn of the bolts (when the turn-of-nut criteria was satisfied). As expected, the strain in the top plate increases in magnitude as the bolts are tightened. However, the net section of the bottom plate (near the bolt holes) experiences a peak strain after six turns, then decreases in magnitude as the bolts are further tightened. During bolt tightening, the bottom plate starts to bend and moves towards the member with minimal initial deformations at the center of the bottom plate. Once the bottom plate comes into contact with the member, the deformations at the center of the plate become more dominant and reach peak strain after the final bolt turn. The hysteresis in the net section of the bottom plates during installation must be accounted for during design, as it enhances the potential for reduced ductility and fatigue resistance of the steel in the cold-worked region.

Scenarios 1, 2, and 3 all used the criss-cross tightening pattern, but with varying increments (or number) of turns at a time. While Scenario 1 and 2 resulted in very similar strain patterns, it was observed in Scenario 2 that tightening in larger increments (three turns per tightening step) resulted in noticeable gouging of the bolts. Scenario 3 (in which bolts were fully tightened individually) is not plotted on FIG. 7 because bolt 3 fractured during the tightening process. Therefore, it is recommended only one full turn of an individual bolt at a time be implemented.

Scenarios 4 and 5 use clockwise and counter-clockwise tightening patterns, respectively, as compared to Scenario 1, which uses the criss-cross pattern. The measured strains in Scenarios 1, 4, and 5 are very similar, as shown in FIG. 7 and in full-field after the final turn-of-nut in FIG. 8. However, there is some asymmetry in the peak strains on the bottom plate which changes location based on the tightening pattern. This asymmetry is more pronounced in the bottom plate as the bottom plates are restrained by just two bolts and are therefore more susceptible to differences in the order in which bolts are tightened, compared to the top plate. This is more pronounced in Scenario 4 and 5 which feature circular tightening patterns as opposed to Scenario 1 which uses the criss-cross pattern. Further, some strain bands occur near the net section of the top plate for Scenarios 4 and 5. This is not desirable as it may reduce fatigue resistance of the connection. As a result, the criss-cross pattern is recommended over circular patterns.

In general the peak strains are not significantly affected by tightening procedure. Therefore the recommended tightening procedure is one turn per increment, with a criss-cross tightening pattern.

The following text describes the impact of the amount (i.e., number of degrees δ) and direction (i.e., increasing or decreasing the angle of the pre-bent plate) on the surface strains induced in the connection. As shown in table 1400 of FIG. 14, four different member angles were investigated (Scenarios 1 and 6-8), with Scenario 1 serving as the baseline for comparison of the measured behaviors. Each scenario used the same bolt tightening procedure as Scenario 1 (i.e., one full turn of an individual bolt at a time, using a repeated crisscross pattern to tighten the entire four bolt connection).

Figure 9:
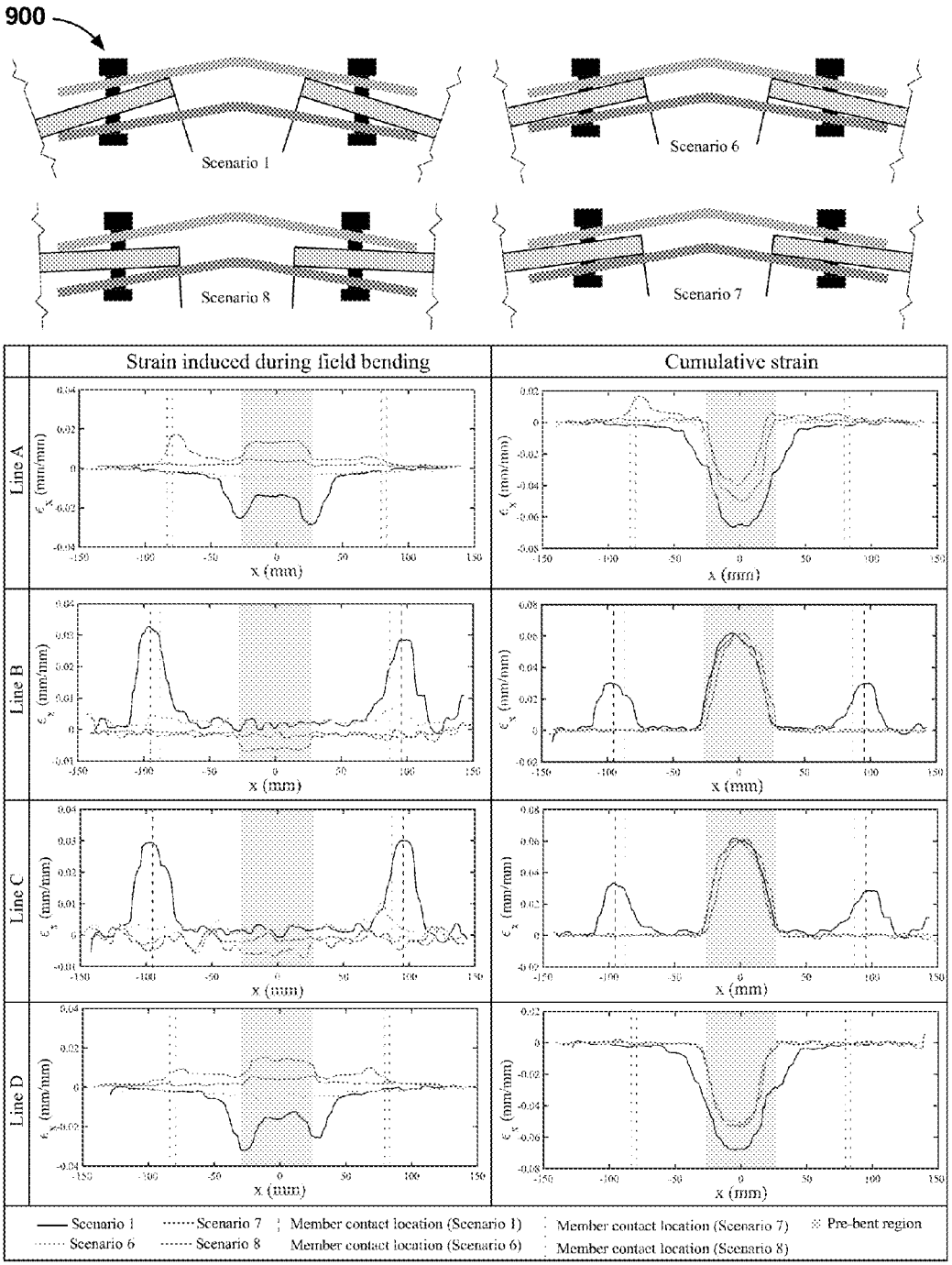
FIG. 9 is a set of graphs showing effects of the amount and direction of bend on the measured circumferential surface strain due to field bending and the cumulative circumferential strain from both prefabrication and field bending.

FIG. 9 is a set of graphs showing measured circumferential surface strain ($\epsilon_x$) along Lines A-D identified in FIG. 6. The left column indicates strain induced during field bending, the right column shows total cumulative strain from prefabrication and field bending. All data is for plates with initial angles $\gamma=\beta=10°$. Scenario 1 bends to a final angle of $\alpha=17.5°$, Scenario 6 bends to a final angle of $\alpha=12.5°$, Scenario 7 bends to a final angle of $\alpha=7.5°$ and Scenario 8 bends to a final angle of $\alpha=2.5°$.

Figure 10:
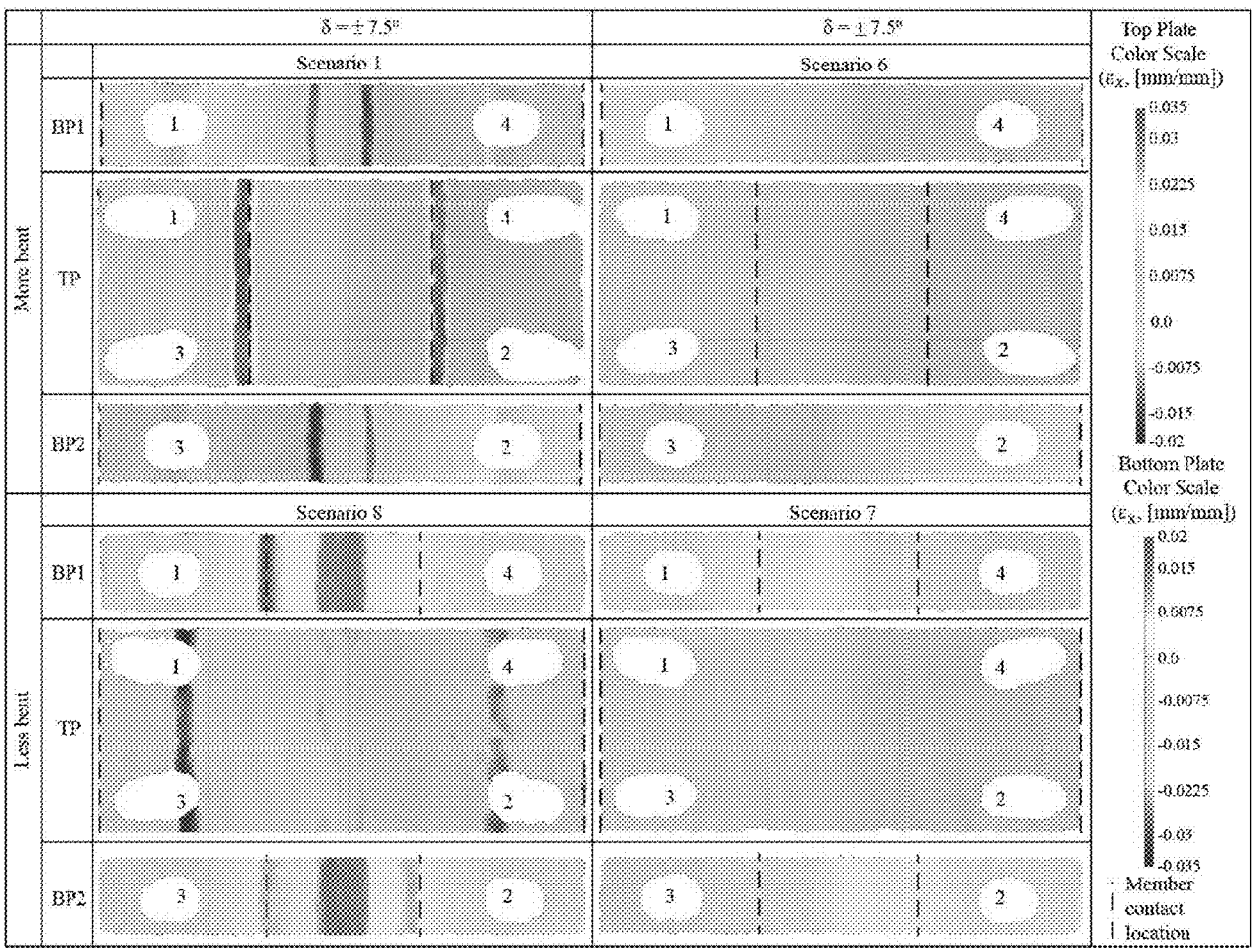
FIG. 10 is a set of full field circumferential strain maps showing effects of the amount and direction of bend.

FIG. 9 (left) shows the measured circumferential surface strains during field bending as a function of the location along Lines A-D and FIG. 10 shows the full-field strains. As expected, compressive strains developed in the top plate while tensile strains developed in the bottom plate for Scenarios 1 and 6 (where $\delta>0$). Similarly, for Scenarios 7 and 8 (where $\delta<0$), compressive strains developed in the bottom plate while tensile strains developed in the top plate. Also as expected, the highest absolute peak strains occurred when the magnitude of the field bend (δ) was largest. The overall peak strain [approximately 0.035 mm/mm (0.035 in./in.)] is observed in Scenario 1 in the top plate near the point of contact with the beams (shown as dashed vertical lines). In Scenario 8, the peak strain [approximately 0.02 mm/mm (0.02 in./in/)] occurred in the net section of the top plate. This is an important feature as the cold working here would reduce the ductility of the plate at the net section (bolt holes) enhancing the potential for reduced fatigue resistance of the steel in the cold-worked region. This was not observed in the plots in FIG. 9 due to data loss along Lines B and C (where the section cut goes through the holes in the plate as shown in FIG. 6). The bolt assembly also blocks a portion of the DIC view of the plate due to the washers being larger diameter [37.0 mm (1.46 in.)] than the holes in the plates [23.8 mm (0.938 in.)].

The peak strains in the bottom plates occur at the edge of the pre-bent region for Scenario 1, but occur in the center pre-bent region and near the line of contact with the beams for Scenario 8. Scenario 8 creates a region of constant moment in between the point of contact with the member, and thus the plateau in the center is expected. In Scenario 8, there are no double peaks in strain around the pre-bent region, as observed in Scenario 1. This is due to Scenario 8 inducing bending in the direction opposite the direction of prefabrication. Here, the Bauschinger effect is lowering the yield stress in the pre-bent region. While the magnitude of this peak strain was smaller, the distribution of plastic strains was much wider (covering the entire pre-bent region of the bottom plate). FIG. 10 shows that some minor strain banding occurs across the top plates outside the pre-bent region, this is believed to be due to inhomogeneity in the grain structure of the steel. Scenarios 6 and 7 (featuring $\delta=+2.5°$ and $-2.5°$ field bends, respectively) had very small measured peak strains [around 0.005 mm/mm (0.005 in./in.)], indicating that small field bends do not generate significant surface strains. To minimize the induced strains, connections with $\delta=\pm2.5°$ or lower are recommended.

In FIG. 10, all data is for plates with initial angles $\gamma=\beta=10°$. Scenario 1 bends to a final angle of $\alpha=17.5°$, Scenario 6 bends to a final angle of $\alpha=12.5°$, Scenario 7 bends to a final angle of $\alpha=7.5°$ and Scenario 8 bends to a final angle of $\alpha=2.5°$.

The right column of FIG. 9 shows the cumulative strains (i.e., strains from field installation plus residual strains from prefabrication). These cumulative strains reach peak magnitudes of approximately 0.07 mm/mm (0.07 in./in.) in the bottom plates of Scenario 1. The bottom plates of Scenario 1 experience the highest cumulative strain because the induced strains from field bending and prefabrication occur in the same region, and the strains are additive because $\delta>0$. In the top plates of Scenario 1, the strain induced during field bending is in a different location than the strain from prefabrication, hence the three distinct peaks along Lines B and C. Conversely, Scenario 8 experiences a decrease in magnitude of cumulative strain because $\delta<0$.

Understanding the cumulative final strain and hysteresis induced are important design factors. Previous studies have found that plastic strains up to 0.10 mm/mm (0.10 in./in.) resulted in minimal effect on ductility and fracture toughness. The measured strains in this study are below this upper limit. Fatigue behavior of steel is not only dependent on applied cyclic load, but also on loading history. The plastic strains induced during prefabrication and field installation have an effect on components subjected to fatigue loading; therefore, strain history must be taken into consideration during the design process. In many of the tested scenarios, the locations of induced plastic strain are not coincident with critical areas of the plates (i.e., the net section across bolt holes), and are not likely to significantly affect the overall design of the connection. The cumulative induced plastic strains will result in reduced fracture toughness and ductility, including also the effect of strain aging. Strain hysteresis produces additional micro-defects that can reduce fatigue life and must be considered in design.

The following text investigates the effect of different plate angles. All scenarios discussed here use the same bolt tightening procedure as Scenario 1. As shown in table 1400 of FIG. 14, four different plate angles were investigated: Scenarios 1 and 9-13. All feature small bend angles ($\delta=\pm2.5°$) and therefore have low strains, with peaks on the order of 0.01 mm/mm (0.01 in./in.).

As shown in FIG. 11, the peak magnitude of strain in Scenario 9 occurs in the top plate near the point of contact with the beam on the right side. This asymmetry can be attributed to slight differences in the height of members in the reaction frame. This scenario is particularly susceptible to slight imperfections in the reaction frame as the plates are initially flat. Scenario 9 bends initially flat plates ($\gamma=\beta=0°$) to a final angle of $\alpha=2.5°$. Scenarios 10 and 11 use plates with initial angles $\gamma=\beta=5°$. Scenario 10 bends to a final angle of $\alpha=2.5°$ and Scenario 11 bends to a final angle of $\alpha=7.5°$.

In Scenario 10, peak strains occur near the center (within the pre-bent region) of the bottom plates. This is consistent with the behavior observed in Scenario 8 which also has a $\delta<0$. Scenario 11, which has a $\delta>0$, exhibits small strain concentrations in the top plate near the line of contact with the member, as expected and consistent with Scenario 1.

Figure 12:
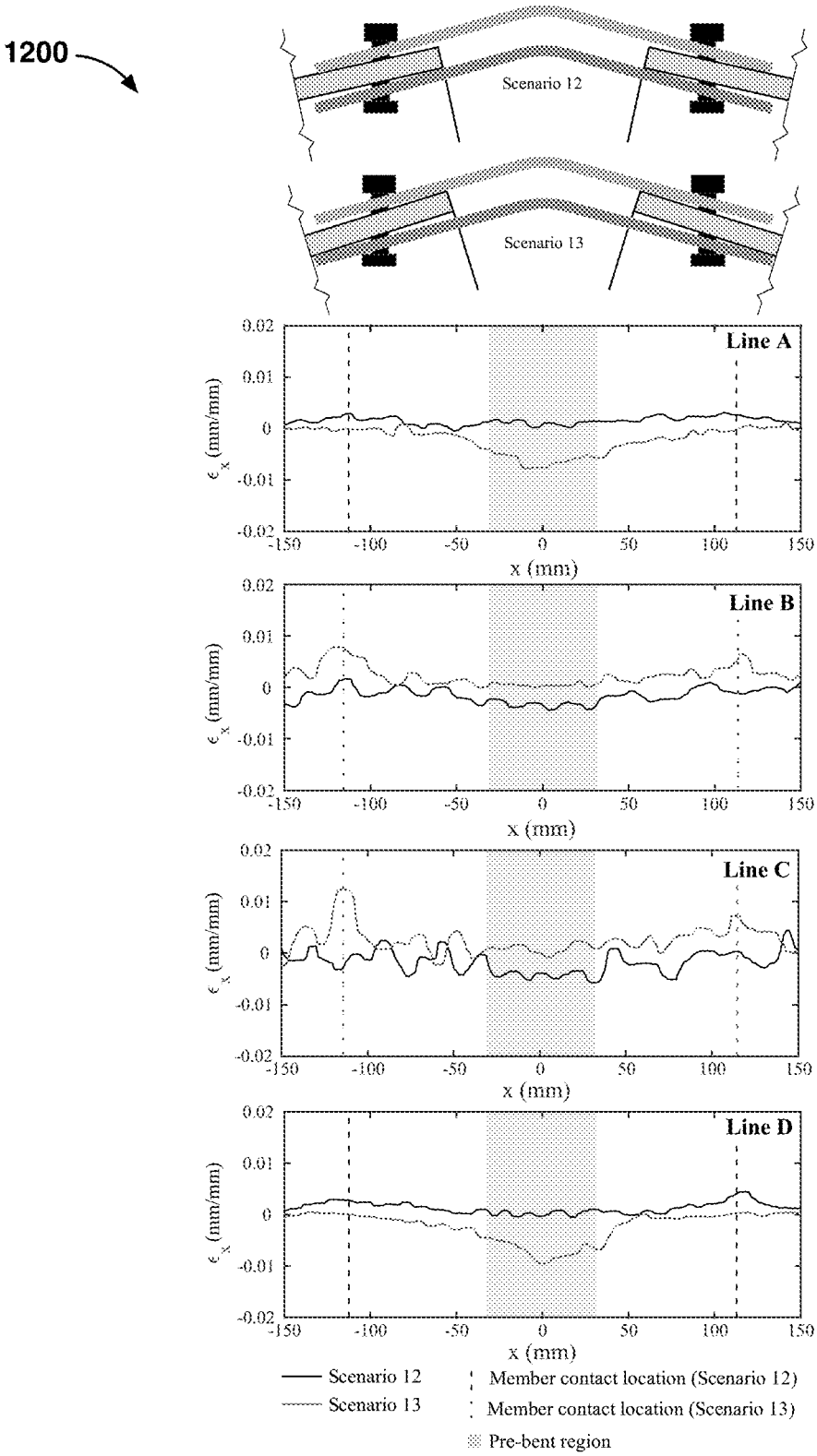
FIG. 12 is a set of graphs showing effects of varying member angles on circumferential strains.

FIG. 12 displays the measured surface strains for Scenarios 12 and 13. In Scenario 12, strains are mostly negligible. Scenario 13 experiences higher magnitudes of strain approaching 0.01 mm/mm (0.01 in./in.), with peaks in the bottom plates at the center, and in the top plates at the lines of contact with the member. This pattern is consistent with that observed in Scenario 1. Scenarios 12 and 13 use plates with initial angles $\gamma=\beta=15°$. Scenario 12 bends to a final angle of $\alpha=12.5°$ and Scenario 13 bends to a final angle of $\alpha=17.5°$.

Overall, this section demonstrates that varying the level of initial pre-bend has little impact on the strains induced during field installation. Rather the amount and direction of bend, as described above, have a more significant impact on the strains induced during field installation.

This disclosure describes an adjustable bolted steel plate connection to join a range of angled steel members. The connection features pre-bent plates that are further bent during field installation via bolt tightening. This research focused on the field installation process following prior work by the inventors on prefabrication. A geometric study was performed to select preferred connection parameters, resulting in the following conclusions:

- Larger member angles reduce the allowable gap between members. In this study member angles ($\alpha$) up to 17.5° were found to result in feasible geometries.
- The versatility of a connection (i.e., range of feasible parameters within a connection) can be increased by using (1) members with thinner flanges [e.g., $t_m$ less than 25.4 mm (1.0 in.)], (2) longer plates [e.g., $l_1=l_2$ greater than 432 mm (17 in.)], or (3) longer slots [e.g., $d_{mh}$=47.6 mm (1.875 in.)]
- Increasing the plate angle will probably decrease the versatility of a connection. This relationship has minimal effect at low plate angles (i.e., $\gamma=\beta=0°$ and 5°), with a more significant effect at higher angles (i.e., $\gamma=\beta=10°$ and 15°)
- The considered radii [63.5 mm and 102 mm (2.50 in. and 4.00 in., respectively)] of curvature do not play a significant role in the versatility of a connection.

Using selected connection parameters based on these geometric analyses, a total of 13 different full-scale connection scenarios were tested to understand the impact of the (1) bolt tightening procedure, (2) amount and direction of field bending, and (3) plate angle on the surface strains induced during field installation. Strains were measured using DIC to capture full-field behavior. Based on these experimental tests, the following conclusions and recommendations are made:

- A preferred bolt tightening procedure features one full turn per tightening increment in a repeated criss-cross pattern to tighten the four-bolt connection. Tightening in larger increments resulted in noticeable gouging or fracture of the bolts. Tightening in circular patterns resulted in more asymmetry of strain patterns.
- Connections where $\delta=\pm2.5°$ are recommended as they were found to minimize induced strain, representing a reasonable limit to fabrication tolerances for bent plates. Residual strains from prefabrication should also be considered.
- For plates where the field bend increased the angle of the plates, the peak strains typically occurred in the top plate near the point of contact with the member. For plates where the field bend decreased the angle of the plates, the peak strains typically occurred within the pre-bent region of the bottom plate.
- High strains were observed in the net section area of the bottom plate during the tightening process for plates where the field bend increased the angle of the plates. For plates where the field bend decreased the angle of the plates, high strains occurred in the net section area of the top plate. These regions require additional attention during design as there is enhanced potential for reduced ductility and fatigue resistance of the steel in the cold-worked region. For connections subject to high cycle fatigue, this may limit acceptable field bending angles ($\delta$).
- The peak induced strain during field bending depends primarily on $\delta$. Varying only the plate angle had negligible effect on induced strains.

These measured results using DIC have provided an unprecedented understanding of this field installation procedure. Additionally the results are relevant to cold bent double shear connections in general and are also useful for assessing their behavior and setting bend tolerances for fabrication.

The scope of the present invention is not limited the recommendations disclosed herein. Adjustable plate connection parameters and tightening procedures explicitly described herein are provided for explanatory purposes, and cover only some embodiments of the present invention.

An adjustable connection—comprising two or more parallel plates as described above—may be operable to adjust to within a range of angles. A given set of plates may be tightened and cold bent to fit joints within a range of angles. For example, the set of plates may be pre-bent along a centerline by an initial angle and capable of being fit to joints whose angle is above or below that initial angle (e.g., an initial angle of 15°, capable of in situ cold bending by ±5°, which is thus suitable for joint angles within the range of 10° to 20°).

In some instances, an assembly includes a set of adjustable connections where each adjustable connection is suitable to be fitted to different ranges of joint angles. An example assembly includes adjustable connections that collectively cover a wide range of angles (e.g., an adjustable connection capable of fitting joints of 5±2.5°, an adjustable connection capable of fitting joints of 10°±2.5° and an adjustable connection capable of fitting joints of 15°±2.5°, among other possible angle ranges; this assembly can be ordered to accommodate a joint whose angle is between 2.5° and 17.5°). The plus-or-minus value may be referred to herein as a "threshold" or "tolerance."

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

We claim:

1. An adjustable structural connection comprising:

a top plate bent along a first longitudinal centerline by a first angle forming a first end and a second end, wherein the top plate includes a front hole at the first end and a front hole at the second end; and a bottom plate bent along a second longitudinal centerline by a second angle forming a first end and a second end, wherein the bottom plate includes a hole at the first end and a hole at the second end, wherein when the first longitudinal centerline and the second longitudinal centerline are substantially aligned along a vertical axis, the front hole at the first end of the top plate vertically overlaps the hole at the first end of the bottom plate, and the front hole at the second end of the top plate vertically overlaps the hole at the second end of the bottom plate, and wherein a tightening bolt is placed through each of the vertically overlapping holes of the top plate and bottom plate that, when tightened, cause the top plate to bend along the first longitudinal centerline by a third angle and cause the bottom plate to bend along the second longitudinal centerline by the third angle.

2. The adjustable structural connection of claim 1, wherein the top plate further includes a back hole at the first end and a back hole at the second end, wherein the bottom plate is a front bottom plate, and wherein the adjustable structural connection further comprises:

a back bottom plate bent along a third longitudinal centerline by a fourth angle forming a first end and a second end, wherein the back bottom plate includes a hole at the first end and a hole at the second end, wherein when the second longitudinal centerline and the third longitudinal centerline are substantially aligned along a vertical axis, the back hole at the first end of the top plate vertically overlaps the hole at the first end of the back bottom plate, and the back hole at the second end of the top plate vertically overlaps the hole at the second end of the back bottom plate, and wherein a tightening bolt is placed through each of the vertically overlapping holes of the top plate and back bottom plate that, when tightened, cause the top plate to bend along the first longitudinal centerline by the third angle and cause the back bottom plate to bend along the third longitudinal centerline by the third angle.

3. The adjustable structural connection of claim 1, wherein the top plate and the bottom plate are steel plates.

4. The adjustable structural connection of claim 1, wherein the holes of the top plate and the bottom plate have a diameter between ⅝ inches and 1 inch.

5. The adjustable structural connection of claim 1, wherein the top plate and the bottom plate have a thickness of ⅜ inches to 1 inch.

6. The adjustable structural connection of claim 1, wherein a distance between the front hole at the first end of the top plate and an edge of the first end of the top plate is 1 inch to 4 inches.

7. The adjustable structural connection of claim 1, wherein the first angle is an angle between 0° and 15°.

8. The adjustable structural connection of claim 2, wherein the back bottom plate is a steel plate.

9. The adjustable structural connection of claim 3, wherein the top plate is cold bent.

10. The adjustable structural connection of claim 3, wherein the top plate is cold bent via a press brake.

11. An adjustable structural connection assembly comprising:

a plurality of adjustable structural connections, each comprising:

a top plate bent along a first longitudinal centerline by a first initial angle forming a first end and a second end, wherein the top plate includes a front hole at the first end and a front hole at the second end; and a bottom plate bent along a second longitudinal centerline by a second initial angle forming a first end and a second end, wherein the bottom plate includes a hole at the first end and a hole at the second end, wherein when the first longitudinal centerline and the second longitudinal centerline are substantially aligned along a vertical axis, the front hole at the first end of the top plate vertically overlaps the hole at the first end of the bottom plate, and the front hole at the second end of the top plate vertically overlaps the hole at the second end of the bottom plate, and wherein tightening bolts placed through each of the vertically overlapping holes of the top plate and bottom plate, when tightened around a joint having a joint angle that is different from the first initial angle and the second initial angle, cause the top plate to bend along the first longitudinal centerline by the joint angle and cause the bottom plate to bend along the second longitudinal centerline by the joint angle;

wherein each adjustable structural connection is operable to be fitted to joints within a respective range of angles that includes angles above or below the respective initial angle by a threshold amount.

12. The adjustable structural connection assembly of claim 11, wherein the ranges of angles collectively define a set of joint angles to which one or more of the adjustable structural connections is operable to be fitted.

* * * * *